United States Patent [19]

Sharon et al.

[11] 4,445,098

[45] Apr. 24, 1984

[54] METHOD AND APPARATUS FOR FAST-SWITCHING DUAL-TOROID MICROWAVE PHASE SHIFTER

[75] Inventors: Thomas E. Sharon, Decatur; Roger G. Roberts, Auburn, both of Ga.

[73] Assignee: Electromagnetic Sciences, Inc., Norcross, Ga.

[21] Appl. No.: 350,418

[22] Filed: Feb. 19, 1982

[51] Int. Cl.[3] ..... H01P 1/397; H01P 1/11; H01P 1/195

[52] U.S. Cl. ..... 333/1.1; 333/102; 333/24.1; 333/158

[58] Field of Search ..... 333/1.1, 102, 24.1, 333/158

[56] References Cited

U.S. PATENT DOCUMENTS

| | | | |
|---|---|---|---|
| 3,277,401 | 10/1966 | Stern . | |
| 3,340,484 | 9/1967 | Siekanowicz et al. . | |
| 3,355,682 | 11/1967 | Taft . | |
| 3,355,683 | 11/1967 | Brown, Jr. et al. . | |
| 3,401,161 | 9/1968 | van Westerveld et al. . | |
| 3,401,361 | 9/1968 | Schloemann | 333/24.1 X |
| 3,411,113 | 11/1968 | Hethaus . | |
| 3,500,261 | 3/1970 | Hai et al. . | |
| 3,519,956 | 7/1970 | Hai et al. . | |
| 3,524,152 | 8/1970 | Agrios et al. . | |
| 3,525,952 | 8/1970 | Siekanowicz et al. . | |
| 3,555,463 | 1/1971 | Ogasawara et al. . | |
| 3,585,536 | 6/1971 | Braginski et al. . | |
| 3,593,216 | 7/1971 | Buck . | |
| 3,599,121 | 8/1971 | Buck et al. . | |
| 3,623,149 | 11/1971 | Smith . | |
| 3,668,563 | 6/1972 | Siekanowicz | 333/24.1 X |
| 3,681,715 | 8/1972 | Freibergs . | |
| 3,753,162 | 8/1973 | Charlton et al. . | |
| 3,754,274 | 8/1973 | Auger . | |
| 3,758,883 | 9/1973 | Cox et al. . | |
| 3,811,099 | 5/1974 | Mason et al. . | |
| 3,835,397 | 9/1974 | D'Antonio . | |
| 3,845,421 | 10/1974 | Charlton et al. . | |
| 3,886,501 | 5/1975 | Lavedan, Jr. . | |
| 3,906,408 | 9/1975 | Siekanowicz . | |
| 3,946,340 | 3/1976 | Simon . | |
| 3,988,686 | 10/1976 | Beall et al. . | |
| 4,042,831 | 8/1977 | Lenhoff, Jr. . | |

OTHER PUBLICATIONS

"Non-Reciprocal Remanence Phase Shifter Rectangular Waveguide", IEEE MIT-2, Feb. 1967 by W. J. and E. Stern.

*Primary Examiner*—Paul L. Gensler

*Attorney, Agent, or Firm*—Cushman, Darby & Cushman

[57] ABSTRACT

The present invention is for an apparatus and method of fast-switching a dual-toroid microwave ferrite phase shifter. A first circuit is provided for controllably switching the ferrite in one of the toroids between a saturated and partially saturated states. A second conduit is provided for controllably switching the ferrite in the other of the toroids between a saturated and partially saturated states. A control circuit is provided for controlling the first and second circuits such that the ferrite in at least one of the toroids is maintained in the saturated state at any given time such that any desired phase shift may be achieved with only one switching operation for each toroid. The present invention provides new reference states such that there are two reciprocal phase states for any given phase state such that a reciprocal phase state may always be achieved with only one switching operation for each toroid.

79 Claims, 56 Drawing Figures

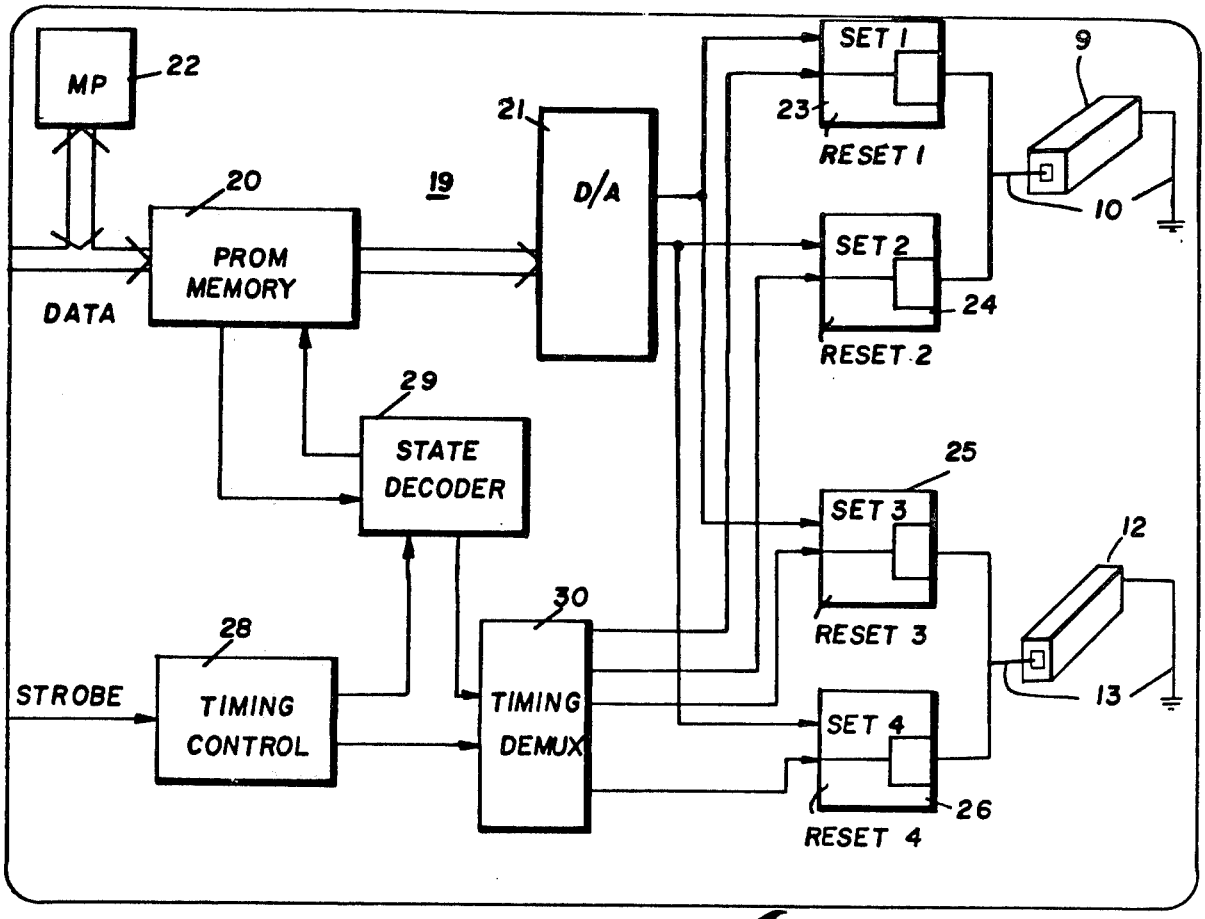
Fig. 1
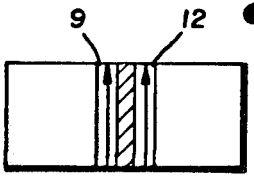
Fig. 5
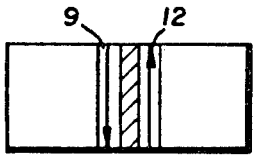
Fig. 8 PRIOR ART
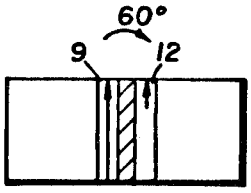
Fig. 6
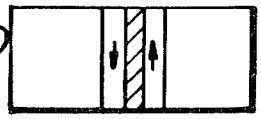
9(a)
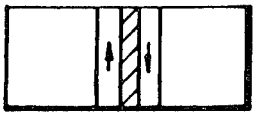
9(b)
Fig. 9 PRIOR ART
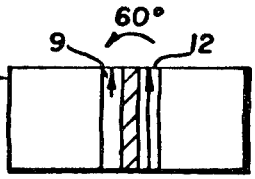
Fig. 7

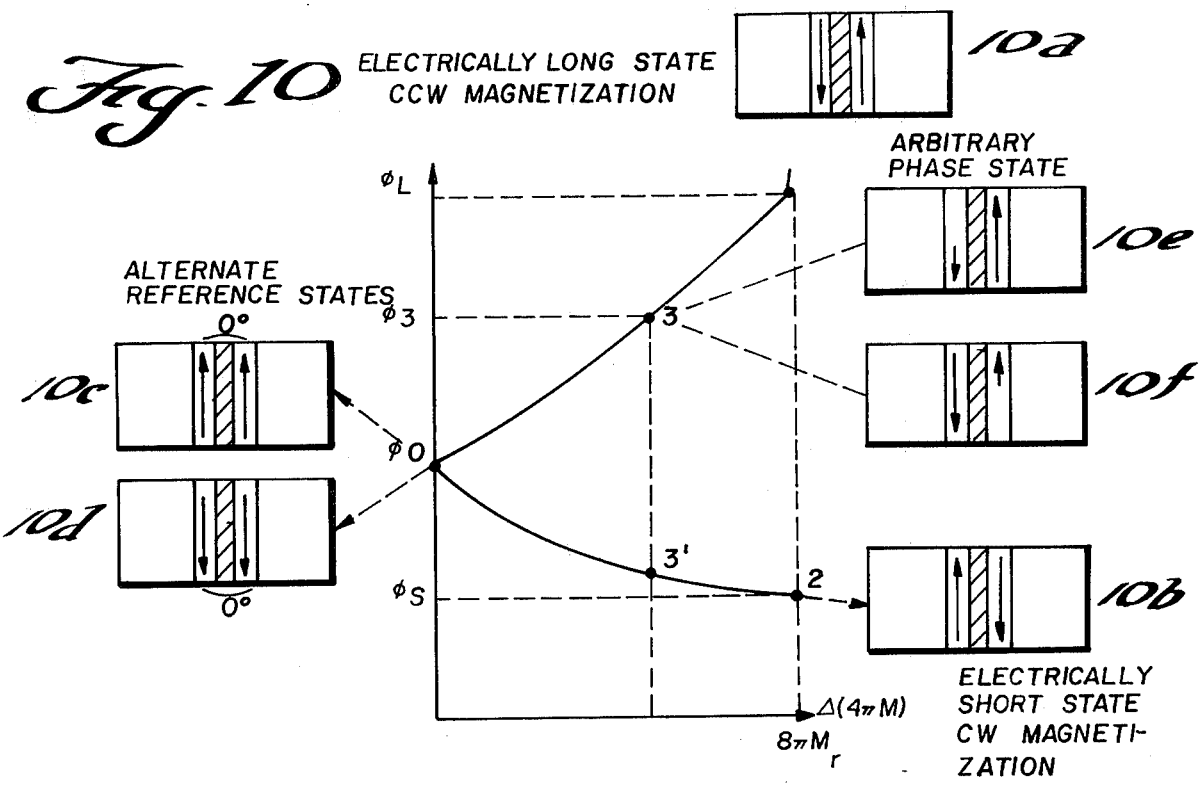
Fig. 10
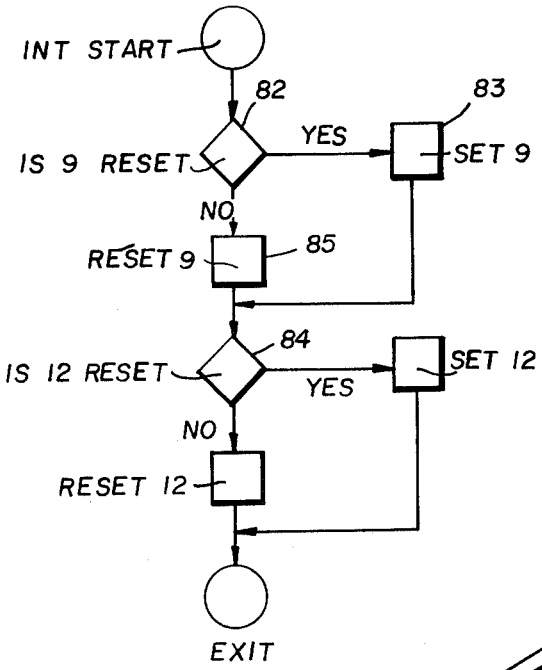
Fig. 11
Fig. 12
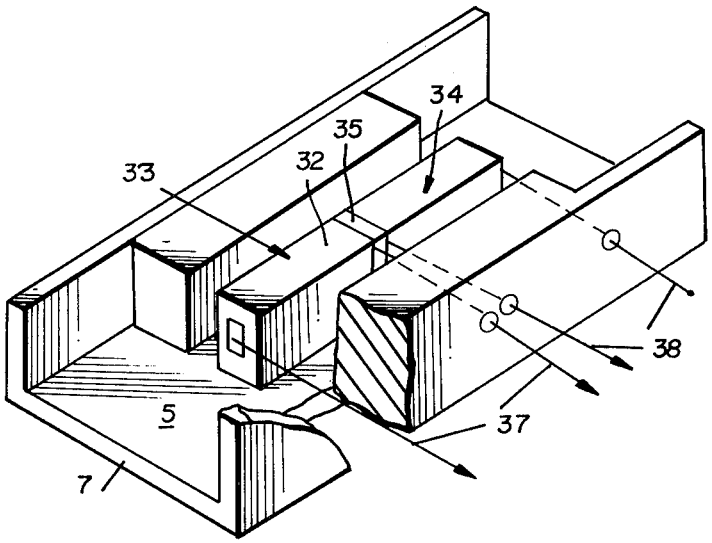

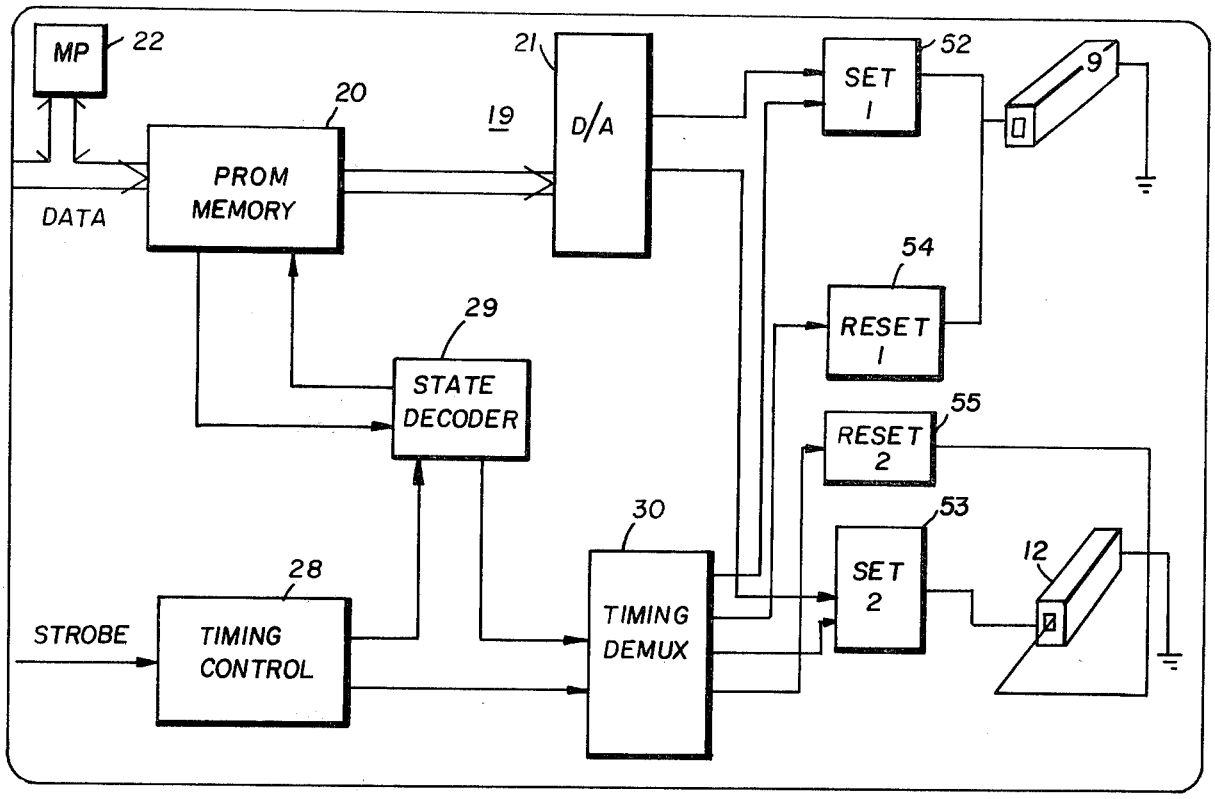
Fig. 19(a)
Fig. 19(b)
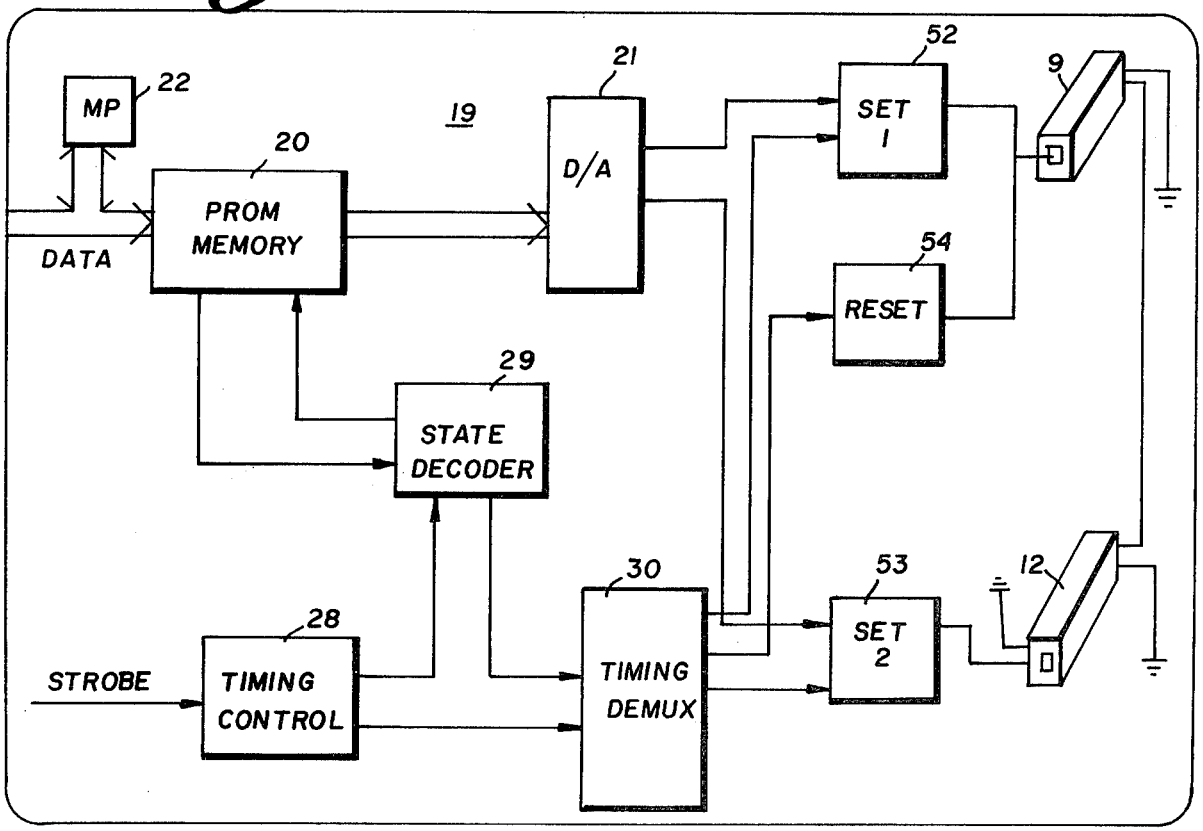

MAGNETIZATION STATES

PRIOR ART PRIOR ART

PRIOR ART PRIOR ART

MAJOR LOOP SWITCHING - CONVENTIONAL TECHNIQUE FOR 4-PORT RECIPROCAL SWITCH USING DUAL TOROID STRUCTURE

Fig. 28
+90° TX
-90° RX
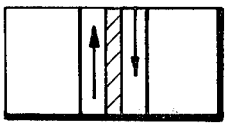
Fig. 29
-90° TX
+90° RX
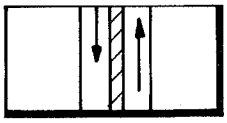
MAGNETIZATION STATES
LEFT TOROID
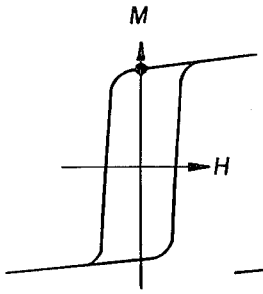
Fig. 30
RIGHT TOROID
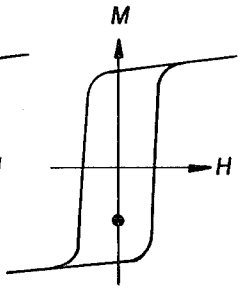
Fig. 31
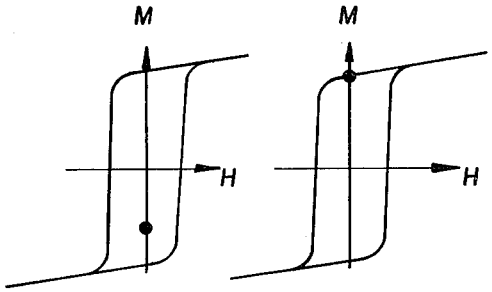
FLUX DRIVE APPROACH TO RECIPROCAL SWITCH USING NEW SWITCHING TECHNIQUE
Fig. 32 Fig. 33

Fig. 34
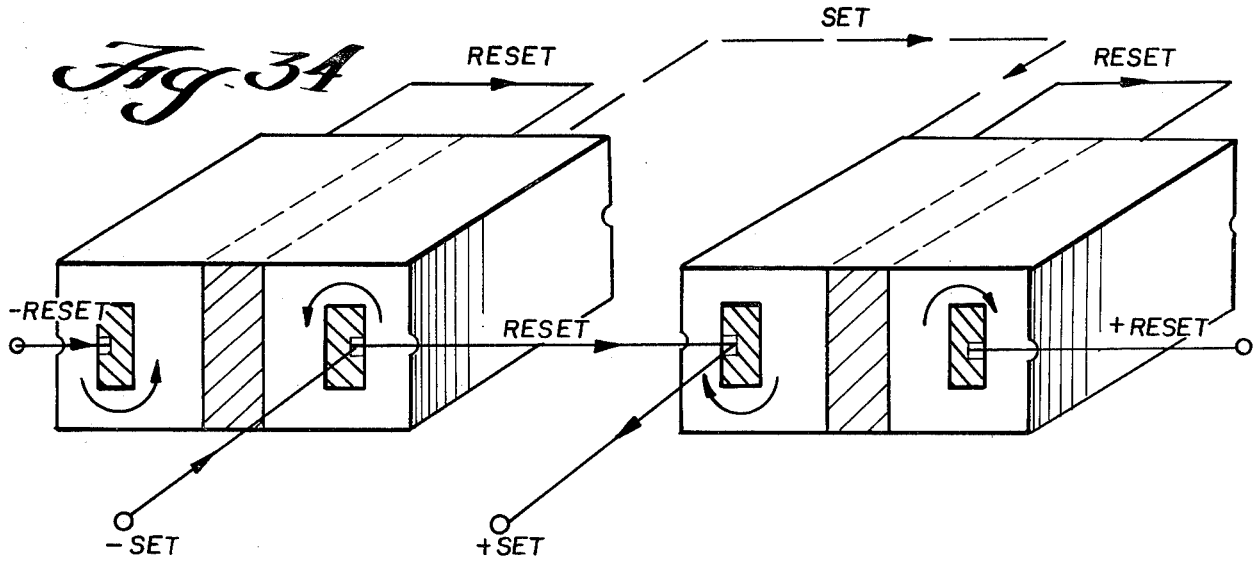
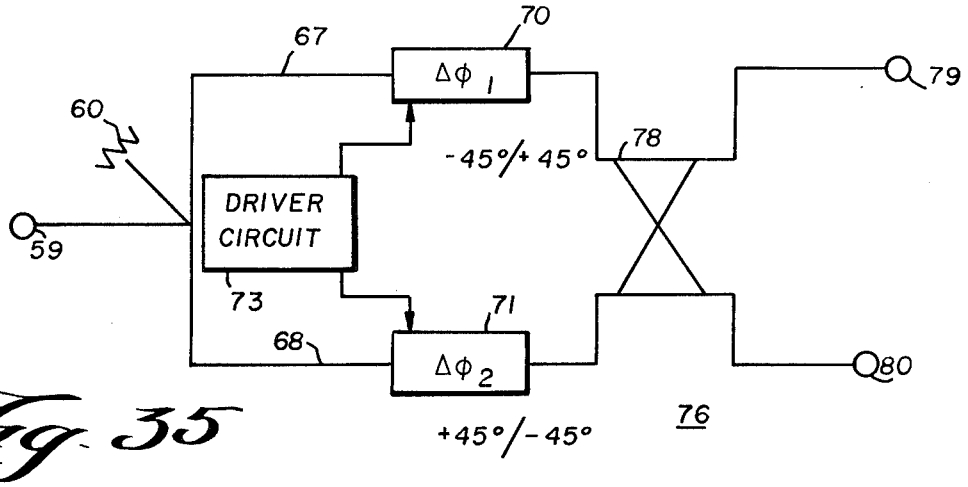
Fig. 35
Fig. 36b
Fig. 36a
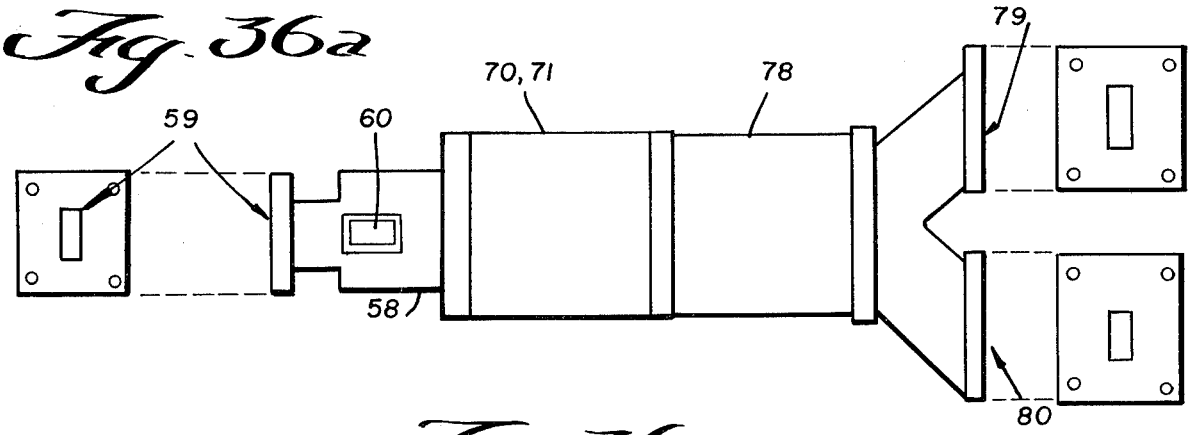
Fig. 36
Fig. 36c EXAMPLE: $\Delta\phi_1$ (6 dB state = +15°)
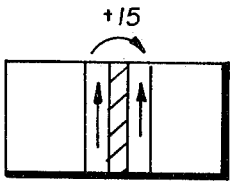
Fig. 37
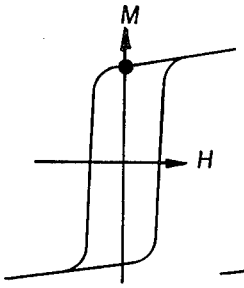
Fig. 39
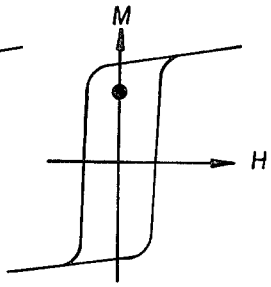
Fig. 40
EXAMPLE: $\Delta\phi_2$ (6 dB state = -15°)
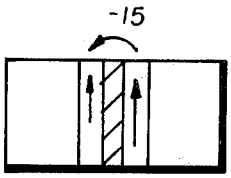
Fig. 38
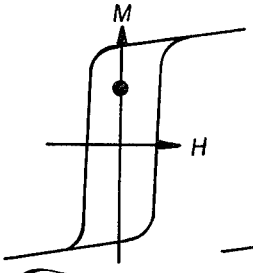
Fig. 41
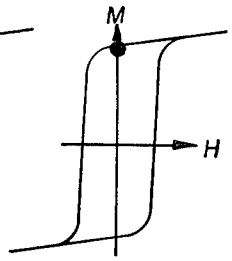
Fig. 42
Fig. 43
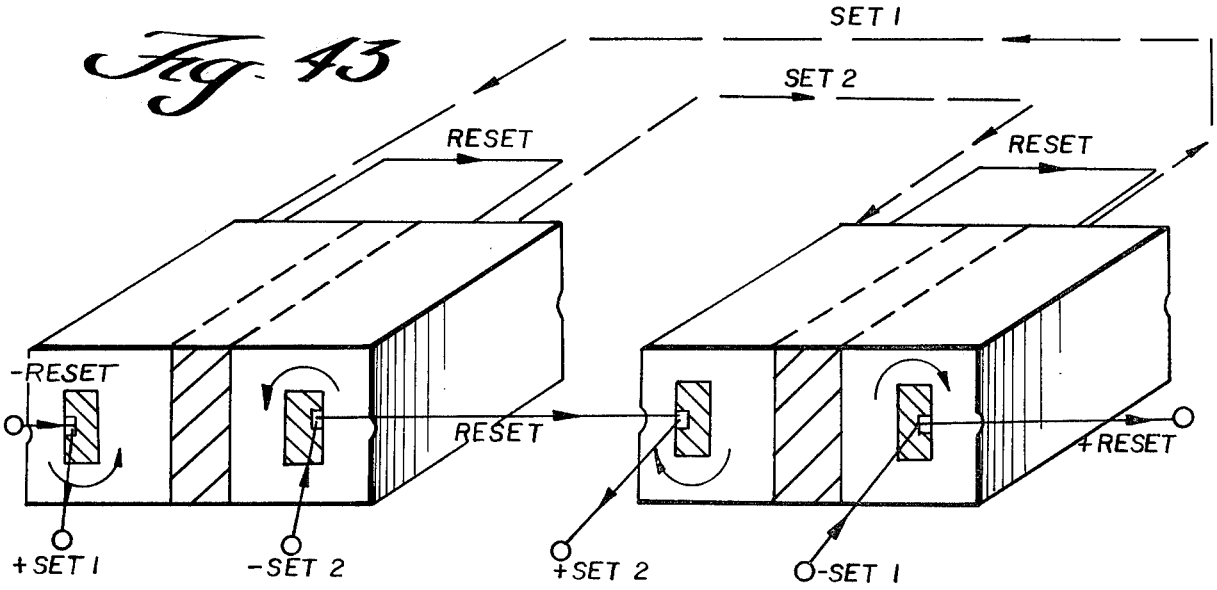

METHOD AND APPARATUS FOR FAST-SWITCHING DUAL-TOROID MICROWAVE PHASE SHIFTER

BACKGROUND OF THE INVENTION

The present invention is directed to microwave phase shifters and more particularly to latching microwave ferrite phase shifters and methods for more quickly switching them between desired phase shifting states.

The phenomenon accompanying the arrangement of two oppositely and equally magnetized ferrite slabs, separated by a di-electric slab and located within a microwave waveguide are well known. Reversal of the magnetization in both ferrite slabs causes a change in insertion phase for a given direction of propagation. This change in insertion phase constitutes a phase shift for that direction of propagation. Further, a change in the magnitude of the magnetization of the two ferrite slabs produces a change in insertion phase for a given direction of propagation. It is therefore desirable to quickly and precisely adjust the magnetization of the ferrite slabs in order to control the phase shift and/or the insertion phase of the waveguide. The present invention is for a method of setting the magnetization levels of the ferrite slabs which is faster than prior art methods and is for an apparatus for executing the method which is simplified in construction over prior art apparatus.

The theory underlying the phenomenon of the ferrite phase shifter need not be fully understood in order to appreciate the present invention's contribution to the art. However, a brief explanation follows in order to provide some background. The reader desiring a more comprehensive treatment is referred to an article entitled "Non-reciprocal Remanence Phase Shifters in Rectangular Waveguide", IEEE MIT-2, February 1967 by W. J. Ince The theory underlining the phenomenon of the ferrite phase shifters states that the insertion phase of the structure varies with the magnetization of the ferrite slab as shown in FIG. 1. Thus, for a given direction of propagation, a ferrite slab magnetized counterclockwise to some saturated state represented by Point 1 would exhibit an insertion phase $\phi_1$. If the magnetization were switched to a clockwise saturated state represented by Point 2, the device would exhibit an insertion phase $\phi_2$. The phase shift experienced in going from state 1 to state 2 would then be $\phi_2-\phi_1$.

On the other hand, if the magnetization were changed in magnitude, for example by going from Point 1 to a Point 3, the phase shift would be $\phi_3-\phi_1$. Therefore, a continuum of phase states are available between the limits of $\phi_1$ and $\phi_2$, which represent saturated states of magnetization. In FIG. 1 the point of zero magnetization is represented by an insertion phase $\phi_0$.

The state represented by point 1 in FIG. 1 is called the "long state" since the insertion phase is highest and that represented by point 2 is called the "short state". The two branches of the curve of FIG. 1 are referred to as clockwise (CW) and counterclockwise (CCW) referenced to the direction of propagation of the wave. Thus, if the ferrite were magnetized in a particular direction (CCW) representing state 1 in FIG. 1 for the transmit direction of propagation, it would exhibit a phase $\phi_1$ to the transmit signal. For the received signal, however, the phase would be $\phi_2$ if the ferrite remains in the same switched state as for the transmit direction of propagation. If the ferrite were switched to the oppositely magnetized state, the received signal would experience an insertion phase $\phi_1$, exactly the same as for the earlier transmitted signal, since the opposite state of magnetization is now counterclockwise referenced to the received signal direction. It is a fundamental principle that reversal of the magnetization, without changing its magnitude, throughout an electromagnetic system has exactly the same effect for a fixed direction of propagation as reversing the direction of propagation without changing the magnetization.

The requirement that the receive and transmit phases be virtually identical requires that the direction of magnetization be reversed without any changes in magnitude of the magnetization no matter what the value of the magnetization may have been.

To make the device a latching phase shifter, one in which no energy is required to hold the device in a given state, it is necessary that the magnetic path be closed into a continuous loop, such that a "square" hysteresis loop is obtained as shown in FIG. 2. To switch the magnetization from a remanent of $-4\pi M_r$ to the opposite remanent value of $+4\pi M_r$, a current pulse is applied to provide a positive magnetization field (H). The magnetization (M) moves upward to the point $+4\pi M_{max}$, at which time the current is turned off reducing the H field to zero. The magnetization then "falls back" to a remanent value of $+4\pi M_r$ and remains there without a holding field, i.e. it is "latched". To return to the $-4\pi M_r$ remanent value, an opposite H field is applied and the magnetization moves to $-4\pi M_{max}$ and then to $-4\pi M_r$ when the H field is reduced to zero. It is important to note that the alegebraic signs plus and minus used in FIG. 2 refer to a particular physical direction of magnetization whereas the notations counterclockwise and clockwise in FIG. 1 are referenced to the direction of propagation. Therefore, if minus in FIG. 2 corresponds to counterclockwise in FIG. 1 for the transmit case, it follows that plus in FIG. 2 is counterclockwise for the received case. The actual dynamics of fast-switching cannot be represented by a hysteresis loop as shown in FIG. 2, which is representative of quasi-static changes. Nevertheless, the concept does represent rest conditions and is very useful in understanding the device.

It is also known in the prior art to drive the ferrite slab to partially saturated states intermediate of the fully saturated states of $4\pi M_r$ and $-4\pi M_r$ by use of a two step sequential switching technique in which a fully saturated state (reference) is followed by a partially saturated state. Referring to FIG. 2, suppose the ferrite slab is at a partially saturated value of $-4\pi M_a$ for a transmit mode, corresponding to a phase state $\phi_a$ for the transmit mode. To set the ferrite slab to a receive mode in the same state, a large forward pulse creating a large H field is applied to move the magnetization to $+4\pi M_{max}$. The pulse is then removed to allow the magnetization to fall to the $+4\pi M_r$ state. This is called a reset operation since the magnetization of the ferrite slab is reset to a known reference value. Shortly thereafter, within one microsecond, a smaller controlled negative pulse creating a negative H field is applied to drive the magnetization to Point A and then removed to allow the magnetization to fall back to the new remanent value of $+4\pi M_a$. This is called a set operation. Control of the set operation is crucial in that the whole concept of switching rests on the ability to switch a controlled amount of magnetic flux in a repeatable fashion over some environmental range. After the reset and set operations are completed the phase shifter is in phase state $\phi_a$ for the receive mode the same as the phase state for the transmit mode. Thus, a two-step operation, reset and set, is required to place the ferrite slab in the appropriate magnetization state. According to the prior art, by using such a two pulse operation, the phase state can be changed from any value to any other value.

The use of minor remanent loops intermediate of positive and negative saturation is well known. See, for example, U.S. Pat. Nos. 3,524,152 to J. P. Agrios et al and 3,340,484 to W. W. Siekanowicz et al. Patents discussing the use of remanent states intermediate of positive and negative saturation typically describe the well known prior art switching technique of first driving the set toroid to a reset condition and then driving the newly reset toroid to the desired set condition as discussed above. See, for example, U.S. Pat. Nos. 4,042,831 to Lenhoff, Jr. and 3,988,686 to Beall et al.

It has also been recognized in the prior art that the degree of phase shift may be varied from a maximum phase to a minimum phase by maintaining the flux in one ferrite toroid constant and switching the flux in the other ferrite toroid as illustrated by U.S. Pat. No. 3,681,715 to Freibergs. This patent also discloses using independent means for energizing each of the ferrite toroids.

The controlled flux technique previously discussed has definite advantages in terms of ease of assembly and microwave performance parameters. However, the switching technique used for a device utilizing the controlled flux technique involves two distinct switching operations (the reset and set operations) which are accomplished sequentially in time. In addition to the two switching operations, it is necessary to insert an additional delay after the reset pulse to allow sufficient time for the ferrite element and the electronics to settle before the set pulse is applied. Using a technique of this type, a recent X-band phase shifter produced at Electromagnetic Sciences was switched in twelve microseconds using a controlled flux driver to produce a multitude of desired phase states. However, in a phased array radar, using non-reciprocal phase shifters, if a pulse of rf energy is sent out by a transmitter, the ferrite elements in the phase shifter must be switched between the end of the transmit pulse and the beginning of the receive pulse reflected from the target. For this reason, the time necessary to switch the device from the transmit state to the receive state is a very critical parameter governing the minimum range target which can be observed. To observe a target at a distance of five hundred feet a switching time of approximately one microsecond is required. It is obvious that the prior art controlled flux switching technique does not provide suitable performance in certain applications such as phased array radars with such switching times.

Another prior art technique for controlling the magnetization states of the ferrite slabs is the mulit-bit technique. For example, a two-state phase shifter can be made by simply switching between $-4\pi M_r$ and $+4\pi M_r$ shown in FIG. 2. This corresponds, for example, to a switching between $\phi_1$ and $\phi_2$ in FIG. 1. If the phase shifter is in state $\phi_1$ at remanent value $-4\pi M_r$ for the transmit mode, it can be put in the same state $\phi_1$ for the receive mode by switching the ferrite slab to the $+4\pi M_r$ remanent value. A four-bit digital phase shifter can be constructed by placing four distinct pieces of ferrite in tandem, with the length of each piece twice as long as the preceding one and adjusting them to have $22\frac{1}{2}°$, 45°, 90° and 180° of phase shift, respectively. Each ferrite piece has it own pair of latch wires and it own driver. The bits are separated by dielectric spacers to avoid interaction of latch currents with adjacent ferrites. Such a configuration has been useful in the past in fast-switching situations when the switching time of the controlled flux phase shifter was excessive. A two microsecond switching time which can be provided by the multi-bit switching technique is unobtainable using the previously discussed prior art controlled flux phase shifters.

Although the use of multi-bit phase shifters provides considerably faster switching times, in situations where more than four bits are required the smaller bits become too small to handle and the final assembly becomes cumbersome. The many interfaces required to prevent interactions because of the accuracy specifications of different materials produce reflections that preclude achievement of various design specifications. Further, the driver needed to drive each of the ferrite pieces becomes extremely expensive. The many latch wires and interfaces tend to produce higher order modes that impair phase accuracy. Thus, although the multi-bit phase shifter provides desirable switching times, in many applications it cannot be used because of the cumbersome physical design.

SUMMARY OF THE PRESENT INVENTION

The present invention is a method and apparatus for fast-switching a dual toroid microwave ferrite phase shifter. The present invention includes two ferrite toroids located within a microwave waveguide. A first circuit for controllably switching the ferrite in one of the toroids between a saturated state and a partially saturated state is provided. A second circuit is also provided for controllably switching the ferrite in the other of the toroids between a saturated state and a partially saturated state. A control circuit controls the first and second circuits such that the ferrite in at least one of the toroids is maintained in the saturated state at any given time. A desired phase shift may be achieved by switching the saturated toroid to a partially saturated state and by simultaneously switching the partially saturated toroid to a saturated state. Thus, any desirable phase shift may be achieved with only one switching operation for each toroid.

The new electronic switching technique of the present invention allows the advantages of the controlled flux device to be combined with the fast-switching properties of the multi-bit devices, resulting in a unique phase shifter configuration suitable for many new applications in which fast-switching and/or high accuracy requirements are involved. Using the new switching technique of the present invention the phase shifter switches as fast as the multi-bit phase shifters and yet has all the construction advantages of the controlled flux phase shifters. At millimeter wave frequencies, for example, the construction problems associated with the multi-bit phase shifter device are indeed insurmountable, and it is impractical to make a multi-bit phase shifter above approximately twenty gigahertz. However, the construction approach used in the controlled flux phase shifters can be extended to frequencies as high as ninety-four gigahertz. Using the switching technique of the present invention, the fast-switching advantages of the multi-bit unit can be incorporated into similar microwave structure being used in the conventional controlled flux phase shifters.

The microwave ferrite phase shifter of the present invention may be used, in addition to its uses as a microwave phase shifter, as a transmit/receive phase shifter and in a reciprocal four-port switch and an anti-reciprocal four-port switch/variable power divider.

Another disadvantage of the prior art controlled flux phase shifter is that in many applications the phase transient associated with the device during the reset operation causes unacceptable microwave performance. In a typical variable power divider, when both phase shifters are reset, the variable power divider will exhibit a 45° phase transient. If such a device is used in a communication system this phase transient will cause distortion of the communication signal. For example, if the system uses a frequency modulated signal, the phase transient will be a disturbance of the normal communication signal modulated on the carrier. In a variable power divider utilizing the switching technique of the present invention it is possible to switch to a new state without any phase transients occurring. These and other features of the present invention will be described in detail hereinbelow.

BRIEF DESCRIPTION OF THE DRAWINGS

FIG. 4 is a block diagram of a circuit for controlling the operation of the phase shifter shown in FIG. 3;

FIG. 5 illustrates the one of the two reference magnetization states of the ferrite cores of the phase shifter shown in FIG. 3;

FIG. 6 illustrates the magnetization states of the ferrite cores of the phase shifter shown in FIG. 3 when the phase shifter is in the transmit mode according to the technique of the present invention;

FIG. 7 illustrates the magnetization states of the ferrite cores of the phase shifter shown in FIG. 3 when the phase shifter is in the receive mode reciprocal to the transmit mode of FIG. 6 according to the teachings of the present invention;

FIG. 8 illustrates the reference magnetization states of the ferrite cores according to the teachings of the prior art;

FIG. 9(*a*) illustrates a transmit mode (approximately 60°) magnetization state according to the teachings of the prior art.

FIG. 9(*b*) illustrates the magnetization states of the ferrite cores when the phase shifter is in the receive mode reciprocal to the transmit mode of FIG. 9(*a*) according to the teachings of the prior art;

FIG. 10 is a graph illustrating the insertion phase versus the change in magnetization away from the fully magnetized state and FIGS. 10*a* through 10*f* illustrate various magnetization states of the ferrite cores according to the teachings of the present invention;

FIG. 11 is a flow chart illustrating the switching technique of the present invention;

FIG. 12 illustrates a fast-switching, single toroid microwave ferrite phase shifter constructed according to the teachings of the present invention;

FIG. 19(*a*) is a block diagram of a circuit for controlling the operation of the phase shifter shown in FIG. 3 when the phase shifter is utilized as a transmit/receive phase shifter;

FIG. 10(*b*) is a block diagram of a circuit for controlling the operation of the transmit/receive phase shifter in the conventional manner using a sequential reset/set operation, but utilizing the magnetization states of the present technique.

FIGS. 28 and 29 illustrate the magnetization states and FIGS. 30 through 33 the associated hysteresis loops for the four ferrite cores of the four-port switch shown in FIG. 20 according to the teachings of the present invention;

FIG. 34 is a wiring diagram illustrating the wiring of the four ferrite cores of the four-port switch shown in FIG. 20;

FIG. 35 is a block diagram illustrating an anti-reciprocal four-port switch/variable power divider utilizing two, fast-switching, dual-toroid, microwave ferrite phase shifters constructed according to the teachings of the present invention;

FIGS. 36, 36*a*, 36*b* and 36*c* illustrate the physical embodiment of the anti-reciprocal four-port switch/variable power divider shown in FIG. 35;

FIGS. 37 and 38 illustrate the magnetization states and FIGS. 39 through 42 the associated hysteresis loops for the four ferrite cores of the anti-reciprocal four-port switch/variable power divider shown in FIG. 35 according to the teachings of the present invention; and FIG. 43 is a wiring diagram illustrating the wiring of the four ferrite cores of the anti-reciprocal four-port switch/variable power divider shown in FIG. 35.

DESCRIPTION OF THE PREFERRED EMBODIMENT

Figure 2:
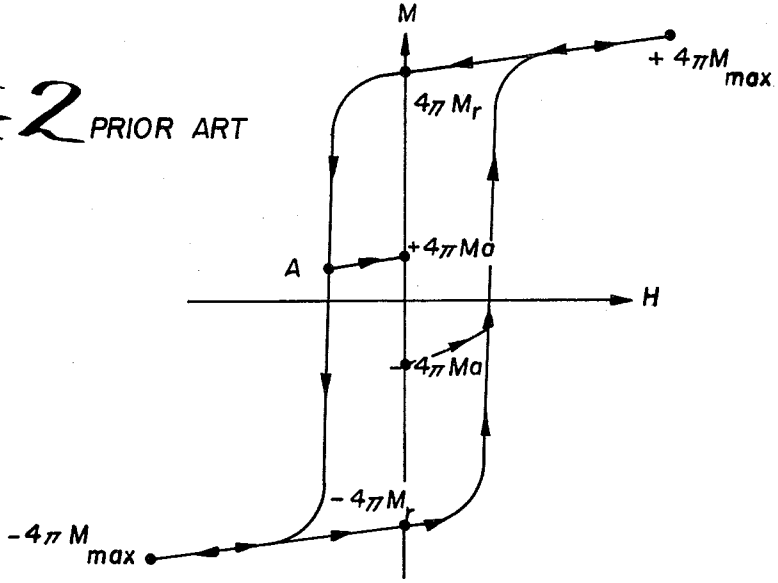
Fig. 2 PRIOR ART
FIG. 2 is a graph illustrating the hysteresis loop of a ferrite core.
Figure 3:
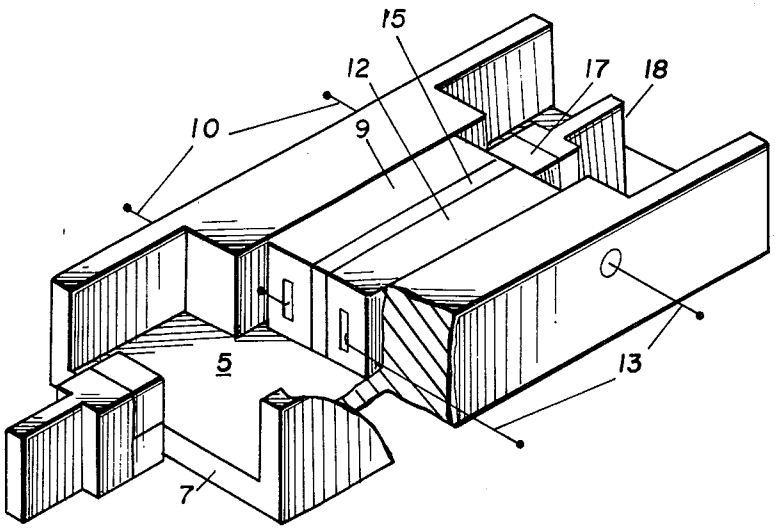
FIG. 3 illustrates a fast-switching, dual-toroid, microwave ferrite phase shifter constructed according to the teachings of the present invention.

Illustrated in FIG. 3 is a non-reciprocal, latching, dual-toroid microwave ferrite phase shifter 5 shown within a waveguide 7. The waveguide housing 7 is shown with the top removed and one side partially broken away. The ferrite phase shifter 5 has a first toroidal ferrite core 9 having a latching wire 10 extending along its axial length. A second toroidal ferrite core 12 has a similar latching wire 13. The latching wires 10 and 13 are provided to set and reset the toroidal ferrite cores 9 and 12. The cores 9 and 12 are separated by a dielectric slab 15. Also located within the waveguide 7 is a mode suppressor 17 and a matching transformer 18.

A block diagram illustrating a circuit 19 for controlling the operation of the phase shifter 5 is illustrated in FIG. 4. A programmable read only memory "PROM" 20 receives data from a microprocessor 22 and an external source not shown in FIG. 4. The microprocessor can be an integral part of the phase shifter control electronics or it can represent an external controller. Output signals from the PROM 20 are input to a digital to analog converter 21 which produces signals for controlling the operation of four set drivers 23, 24, 25 and 26. Each of the drivers 23 through 26 has a set and reset driver. The reset and set drivers of the driver 23 drive the ferrite 9 to saturated and partially saturated positive magnetic remanent states, respectively. The reset driver and set driver of the driver 24 drive the toroid 9 to saturated and partially saturated negative magnetic remanent states, respectively. In a similar fashion the drivers 25 and 26 control the magnetic remanent state to which the ferrite 12 is switched.

The control circuit 19 also contains a timing control circuit 28 receiving stobe signals, a state decoder 29 responsive to the PROM 20 and a timing demultiplexer 30 responsive to both the state decoder and the timing control circuit. The timing control circuit 28, the state decoder 29 and the timing demultiplexer 30 cooperate to produce control signals for activating various ones of the drivers 23 through 26 to prepare them for receiving the switching information from the digital to analog converter 21. Details concerning the construction and operation of the drivers 23 through 26 are provided hereinbelow in conjunction with FIGS. 12 through 17.

The operation of the ferrite phase shifter illustrated in FIG. 3 and controlled by the control circuit illustrated in FIG. 4 may be more easily understood by referring to FIGS. 5, 6 and 7. In FIG. 5 the reference remanent magnetization values of the ferrite cores 9 and 12 are illustrated by the arrows. In FIG. 5, both ferrites are fully magnetized and parallel in orientation, forming one of the two possible reference phase states (resulting phase shift is 0°). In FIG. 6, the ferrite core 12 has been set to a remanent magnetization value such that the overall phase shift provided by the combination of both ferrite cores 9 and 12 is positive 60°. In order to switch the phase shifter so as to provide the same phase shift for propagation of a microwave in the opposite direction, the reset core 9 is set and the set core 12 is reset as shown in FIG. 7. In FIG. 7, the ferrite 9 is set to the value which the ferrite 12 had in FIG. 6 while the ferrite 12 is reset to a saturated condition. The phase shifter now exhibits the same phase shift of 60° for waves propagating in the opposite direction.

The important feature of the present invention is that the phase shifter 5 was placed in the proper condition by executing only one operation on each ferrite core. That is, the reset ferrite core 9 was set and the set ferrite core 12 was reset. Thus, by maintaining at least one of the ferrite cores in the reset condition, any desired phase shift may be achieved with only one operation for each toroid.

FIGS. 5, 6 and 7 are to be contrasted with FIGS. 8 and 9 which illustrate the prior art controlled flux switching technique. Using the prior art controlled flux switching technique the reference state for the ferrite cores 9 and 12 would be fully magnetized, equal and oppositely, as shown by the arrows in FIG. 8. The prior art phase shifter, once placed in the configuration shown in FIG. 9(*a*), would require two switching operations before the complimentary state shown in FIG. 9(*b*) is reached. The ferrite core 9 would be driven from positive saturation to negative saturation in one reset operation. However, the core 12 must first be driven to negative saturation, an appropriate settling time must pass and then the core must be driven to the appropriate remanent state as shown in FIG. 9. Thus, the prior art control flux switching technique illustrated in FIGS. 8 and 9 requires approximately twelve microseconds to switch states while the switching technique of the present invention illustrated in FIGS. 5, 6 and 7 requires approximately two microseconds for a typical X-band phase shifter.

Figure 1:
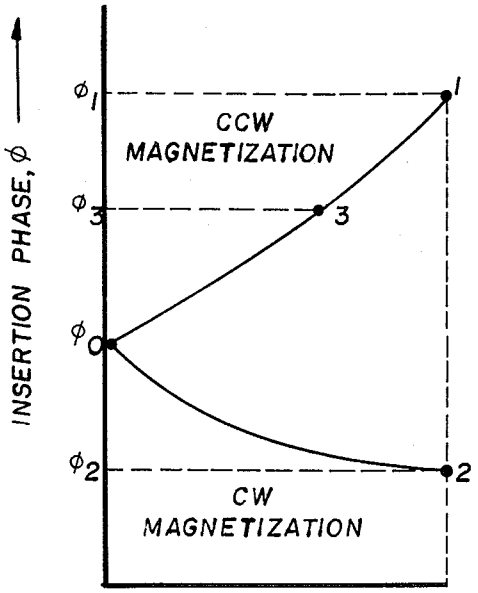
Fig. 1 PRIOR ART
FIG. 1 is a graph illustrating the dependence of the insertion phase on the direction and magnitude of the magnetization of the ferrite slabs, according to the teachings of the prior art.

Having illustrated one example of the new switching technique, a plot of the phase versus magnetization, similar to FIG. 1, may be produced to account for the new states of the dual-toroid phase shifter which results from an application of the present invention. In FIG. 10, the long $\emptyset_1$ and short $\emptyset_s$ phase states appear in their original positions on the vertical axis. See FIGS. 10*a* and 10*b*. However, according to the present invention, the horizontal axis represents the change of magnetization away from the fully magnetized $\pm 4\pi M_r$ case. The range of the horizontal axis varies from 0 to $8\pi M_r$. The point at which the curves cross the vertical axis represents not the demagnetized state as in FIG. 1, but the state at which the ferrites are magnetized to either the "↑ ↑" or the "↓ ↓" states as shown in FIGS. 10*c* and 10*d*. These states have the same phase value. Since each phase state now corresponds to two distinct magnetization patterns, this curve in FIG. 10 is now represented by four branches rather than the two branches shown in FIG. 1. The two possible magnetization states corresponding to a particular phase are illustrated in FIGS. 10*e* and 10*f*.

As can be seen from FIGS. 6 and 7 and FIGS. 10*e* and 10*f* the general states of magnetization of interest in the present invention are those in which one ferrite is magentized fully to a major remanent point and the other ferrite is in a partially magnetized state. This corresponds to the configuration achieved when one ferrite is reset and the other ferrite is set by the electronic drivers 23 through 26 shown in FIG. 4. One distinctive feature of the present invention is that either of the ferrites may be reset to either a positive or a negative major remanent point. On the next switching operation one of the electronic drivers 23 through 26 will then produce a controlled magnetization change away from this reference point and set the ferrite to a partially magnetized state. Each ferrite will alternate between a reset state and a corresponding set state, although a ferrite may be reset as many times as desired in a consecutive manner. However, neither ferrite may be subjected to consecutive set operations since such a switching operation on the hysteresis loop is not possible in a temperature stable manner without first returning to a stable saturated reference point.

The switching scheme of the present invention allows any change of phase with only one switching operation for each ferrite. This is to be contrasted with the conventional controlled flux switching technique described above with reference to FIGS. 8 and 9, wherein two switching operations are necessary. Usually, according to the prior art technique, a reset operation magnetizes the ferrite to a reference point and a second set pulse magnetizes the ferrite to an appropriate partially magnetized state. In addition to the two switching operations, it is necessary to insert a sufficient delay between the pulses to allow for both the settling time of the magnetization and the electronic circuit.

In the switching technique of the present invention the ferrite cores are connected to separate drivers 23 through 26 illustrated in FIG. 4. The operation of the drivers 23 through 6 is controlled according to preprogrammed instructions by the mircroprocessor 22 shown in FIG. 4. A flow chart illustrating the instructions which the microprocessor 22 utilizes to control the drivers 23 through 26 is illustrated in FIG. 11. In FIG. 1, the switching technique of the present invention is initiated by testing the ferrite core 9 to determined if it is in a reset condition. When the ferrite 9 is in the reset condition the microprocessor 22 instructs the circuitry to set the ferrite core to the desired remanent state as shown by block 83. After nitiating the setting of the ferrite core 9, the microprocessor proceeds to step 84 wherein the condition of the ferrite core 12 s determined. If the ferrite core 9 is not reset the microprocessor, at step 85, initiates resetting of the ferrite core 9 and proceeds to step 84.

At step 84 the microprocessor 22 performs the same function on the second ferrite core 12. If the ferrite core 12 is reset, setting is initiated, and conversely, if the ferrite core is set, resetting is initiated. As will be appreciated, the required set and reset functions are thus detected and initiated substantially simultaneously—i.e., only a few microcomputer instruction cycles are required. If desired, separate parallel processing may be performed so as to initiate the set and reset operations concurrently. In a typical switching transition, one ferrite is reset while the other is set. The microprocessor 22 stores data representative of the previous state of the ferrite cores. Thus, by knowing the new state which the ferrite core is to be in and the previous state of the ferrite core the proper switching operation is uniquely defined and can be implemented precisely (and simultaneously) by conventional logic circuitry as illustrated in FIG. 4.

In FIG. 12 an alternative embodiment of the present invention is illustrated. A single ferrite toroid 32 has a first portion 33 and a second portion 34 separated by a discrete distance 35. The first portion 33 and the second portion 34 act as two independent ferrite cores. Accordingly, the first and second portions 33 and 34 have individual latching wires 37 and 38, respectively. The ferrite phase shifter 5 shown in the waveguide 7 in FIG. 12 operates in an identical, manner to the ferrite phase shifter 5 shown in the waveguide 7 in FIG. 3. Accordingly, the phase shifter 5 of FIG. 12 may be controlled by a control circuit 19 as shown in FIG. 4.

According to the present invention, at least one of the ferrites is maintained in the reset state. In general this value is $-4\pi M_r$ or $+4\pi M_r$. The reset state is accomplished by applying a large voltage pulse $V_f$ of sufficient amplitude and duration to generate a magnetizing force of at least four times the coercive force of the material. For the set operation, it is necessary to precisely control the amount of flux in a repeatable fashion over the environment to which the phase shifter is exposed. Therefore, it is crucial that the set driver be able to insure that the value of $\int V_{fdt}$ be constant for a given phase state over the required temperature range, age, and external voltage variations.

There are a variety of techniques for controlling the value of $\int V_{fdt}$. These employ a rectangular pulse which can be varied in amplitude, width, or both. Errors may be introduced from a variety of sources such as variations in pulse amplitude, pulse width, transition and storage times of the driving circuits, and voltages induced by the ferrite as the magnetization "falls back" to its residual value. These errors are discussed later in conjunction with FIGS. 12 through 15. The present invention employs a technique for calibrating out these errors so that phase shift errors occur only due to changes after the initial calibration.

The phase shift from the reference magnetization state is a function of the flux change created by the precisely controlled set voltage pulse. Unfortunately, this phase shift is not a linear function of $\Delta\emptyset$. Although smooth and monotonic, this function can vary significantly even among devices manufactured from a common batch of ferrite material.

In order for a phase shifter to be commanded in a linear function, i.e., in equal discrete steps, it is necessary to generate a linearization function which maps each command into a flux change yielding the required phase shift. The composition of that intrinsic curve with an appropriate linearization function creates the phase shift versus command function which is linear. Because of the variations in intrinsic curves, the linearization functions must be created for each phase shifter individually.

There are several prior art analog curve shaping circuits which can be used to generate the required linearization function. These require that the command first be converted to an analog representation which can then be shaped by a series of adjustable networks. This results in a piecewise linear approximation of the linearization function where the number of linear segments, and hence the number of adjustments, is determined by the accuracy with which the linearization function must be reproduced. The phase shift accuracy is, of course, directly dependent on the faithfulness of the reproduction.

Although these prior art techniques have been used successfully in applications requiring accuracies on the order of 4°, there are serious drawbacks to this approach. As the accuracy requirements are tightened, the number of adjustments necessary increases drastically. These adjustments must be general enough to accommodate the extreme variations in intrinsic curves that might occur. The resulting shaping circuits would require significant board areas with a number of selected or adjustable components. The process of calibrating such a device is tedious and subject to operator error since this technique is not well-suited to automatic testing and calibration. Clearly, in view of the accuracy requirements of the present invention, an analog shaping technique is not a viable alternative.

The inventors of the present invention have developed a unique digital linearization technique which virtually eliminates the problems associated with the prior art analog shaping technique. The technique of the present invent:on employs the programmable read only memory 20, illustrated in FIG. 4, to permanently store a representation of the linearizing function of the individual ferrites. In this technique, the digital input command from the microprocessor 22 addresses a word in the PROM 20 which has been programmed to contain a value representing the flux change necessary to produce the desired phase change. This modified command word is then used to control the set pulse generating circuitry. The accuracy with which the required linearization table can be reproduced is limited only by the quantization of the flux change. Normally, the set drivers of the drivers 23 through 26 are designed so that the quantization effect is $\frac{1}{4}$ to $\frac{1}{8}$ of the smallest desired phase change. Thus, in one embodiment, a 512 state (9-bit) phase shifter may have a 4,096 state (12-bit) flux change representation.

In actual practice, this digital linearization technique offers several advantages. During the calibration process the linearizing function to be stored in the PROM 20 is characterized empirically using the actual pulse generating circuitry. The value stored in each memory location is determined by measuring the phase produced by each available value and selecting the one which most nearly achieves the desired phase change. In this way, errors introduced because of variations in pulse amplitude or pulse width, transition and storage times of the driving circuits and voltages induced by the ferrite as the magnetization "falls back" to its residual value are calibrated out, leaving only the quantization errors. In addition, this method allows insertion phase adjustment since the word corresponding to the zero command need not produce zero phase shift, but can be adjusted to match a standard unit. Clearly, this technique is well-suited to applications requiring highly accurate phase shifters.

That part of the driving electronics which generates and controls the set voltage puslses is most critical in terms of phase accuracy. The following paragraphs briefly discuss several configurations which may be used for the set drivers of drivers 23 through 26 shown in FIG. 4 and the maximum errors to be expected for these driver approaches over a 15° C. temperature range.

Figure 13:
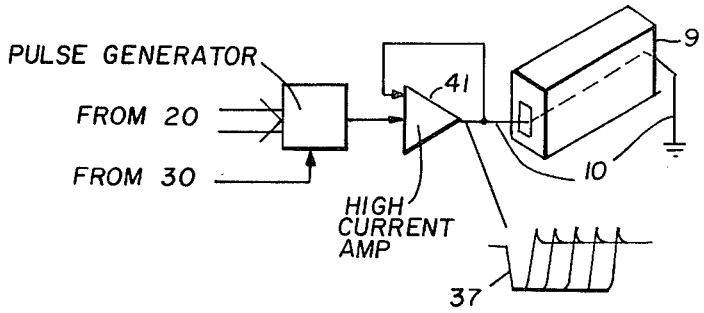
FIGS. 13 through 16 are electrical schematics illustrating various types of set pulse drivers.

The first set driver configuration to be considered, shown in FIG. 13, involves applying a fixed amplitude voltage pulse 37 with the pulse width determined directly by the modified command output from the PROM 20, i.e., the digital to analog converter 21 is not utilized in this embodiment. When small values of $\Delta\emptyset$ are required, the pulse 37 is very short and increases to about four microseconds for a typical X-band phase shifter as the phase command approaches 360°. The main sources of error in this approach are amplitude variations, pulse width control accuracy and pulse shape variations.

Methods of controlling the amplitude range from a simple saturating transistor switch (not shown) which provides very poor control, to a feedback stabilized linear amplifier (not shown) which can provide very accurate control. Using digital clocking techniques, pulse width errors can be made quite small. The major problem with this approach is that the temperature dependent pulse shape variations create substantial errors at the low phase states. This approach is therefore not considered suitable for a fast switching embodiment.

Figure 14:
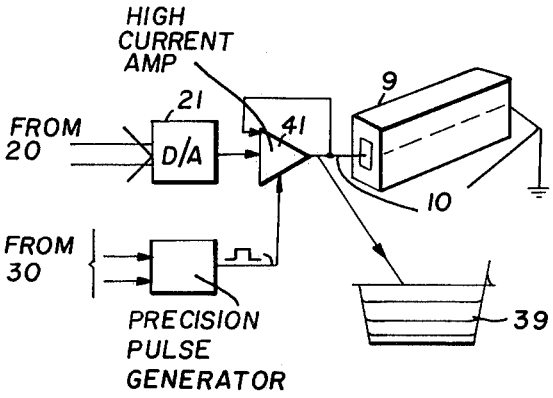
Figure 15:
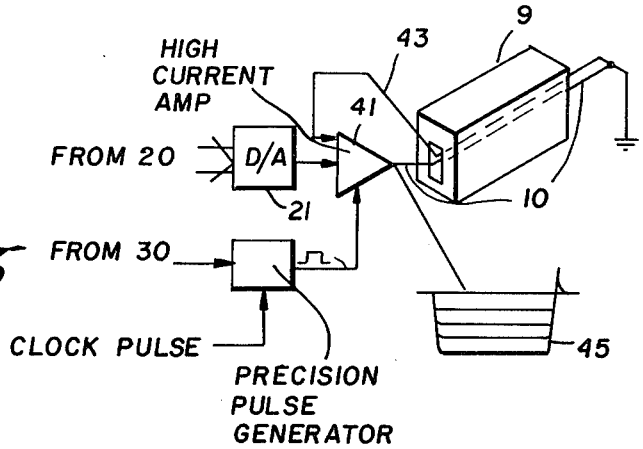

In the approach illustrated in FIG. 14, the width of the pulse 39 is held constant and the pulse amplitude is varied to achieve the various phase states. This eliminates the problem in the previous approach in that $\Delta\emptyset$ can be varied to essentially zero. The pulse amplitude is controlled by an amplifier 41 having a unity gain linear stage driving a current gain stage with feedback from the output to the first stage. The controlling voltage is derived from an 8 or 12-bit digital to analog converter 21. The major sources of error in pulse amplitude are due to quantization and temperature sensitivity of the digital to analog converter 21, gain and offset variations in the amplifier 1, and voltage drops in the latch wire 10 and connectors which are not in the feedback loop.

Two possible methods of generating a controlling pulse width are an R-C controlled one-shot (not shown) which can be made to achieve an error of 1.8° or a stable crystal oscillator (not shown) which together with associated logic produces an error of approximately 0.07°. Variations in transition times can cause an error of 0.15°. Thus, this approach can achieve worst-case accuracies on the order of 1.5° with a crystal time base and 3.2° with the one-shot, for remote drivers.

One of the major sources of error in the embodiment shown in FIG. 14 is uncontrolled drops in the latch wire 10. The inventors have developed an approach, shown in FIG. 15, which utilizes a variable amplitude, fixed width voltage pulse 45 with induced feedback for eliminating these errors and at the same time allowing the driver to compensate for temperature dependent changes in the magnetic properties of the ferrite 9. This approach involves sensing the induced voltage on a second wire 43 passing through the ferrite 9 and using this voltage for the linear amplifier feedback. Since the current in this wire 43 is very low, there are essentially no voltage drops in this path. Thus, maintaining a constant induced voltage rather than a constant applied voltage tends to improve the accuracy. By eliminating errors due to voltage drops in the latch wire 10, this approach improves accuracy to about 0.65° with a highly crystal clock or about 2.4° with one-shot.

Figure 16:
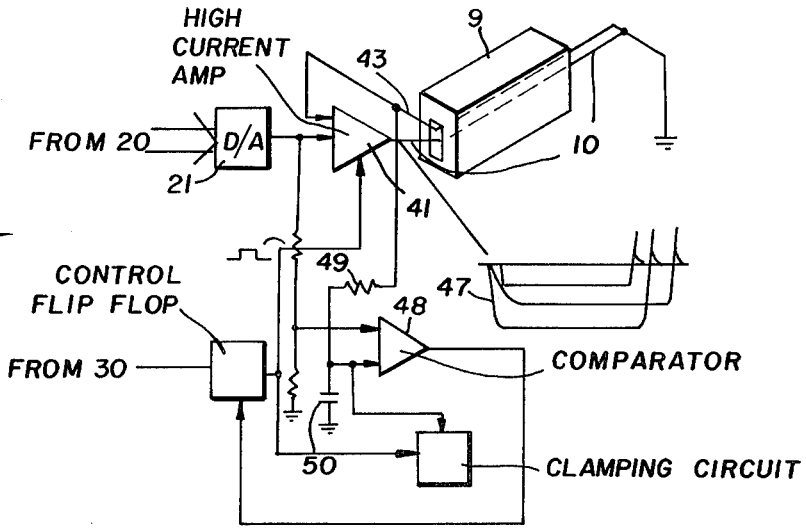

Since $\Delta\emptyset$ actually depends on the integral of the set voltage and not solely on the amplitude of the set voltage, the approach shown in FIG. 16 senses the integral of the set voltage and uses it as a feedback signal to produce a variable amplitude, quasi-constant width voltage pulse 47. Here, the amplitude of the applied voltage pulse 47 is varied and controlled as in the configuration shown in FIG. 15, but the exact duration of the pulse 47 is determined by a comparator 48 which compares the voltage produced by the digital to analog converter 21 with the voltage produced by a simple resistor 49- capacitor 50 integrator. The pulse width of the pulse 47 is determined then by the integral of the applied voltage. Since the amplitude of the pulse 47 varies with the phase state, the resulting pulse width is almost constant. Because the point of turn-off is determined by the integral of the set voltage, errors due to turn-on variations and pulse amplitude are compensated by the pulse width. In addition, accurate pulse width generators are not required.

In the embodiment illustrated in FIG. 16, errors are due to the comparison circuit and variations in turn-off time. Comparison errors include digital to analog variations, quantization errors, variations in the R-C integrator, changes in comparator offset, changes in comparator response time and pulse turn-off variations. Predicted errors for the driver shown in FIG. 16 are approximately 0.72°. Although this approach appears to suffer slightly in accuracy, it does have an advantage over the embodiment shown in FIG. 15 in that it does not require a crystal time base.

Any of the approaches outlined in FIGS. 13 through 16 are suitable for use in present invention as set drivers for the drivers 23 through 26. The exact configuration selected depends on accuracy requirements, part selection, etc. Block diagrams for the reset drivers have not been illustrated since it is only necessary for the reset driver to supply a voltage pulse of sufficient amplitude and duration to generate a magnetizing force of approximately four times the coercive force of the ferrites. Thus, accuracy is not a consideration in the design of the reset drivers of the drivers 23 through 26.

Figure 17:
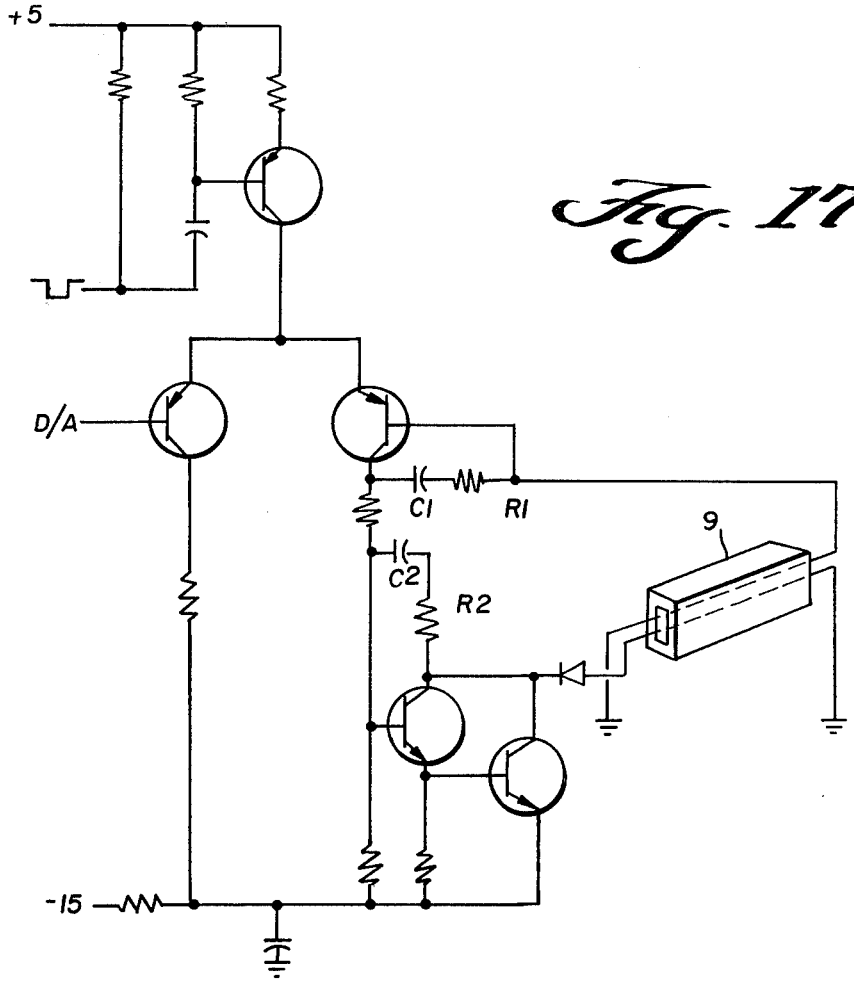
FIG. 17 is an electrical schematic of a typical set output stage.
Figure 18:
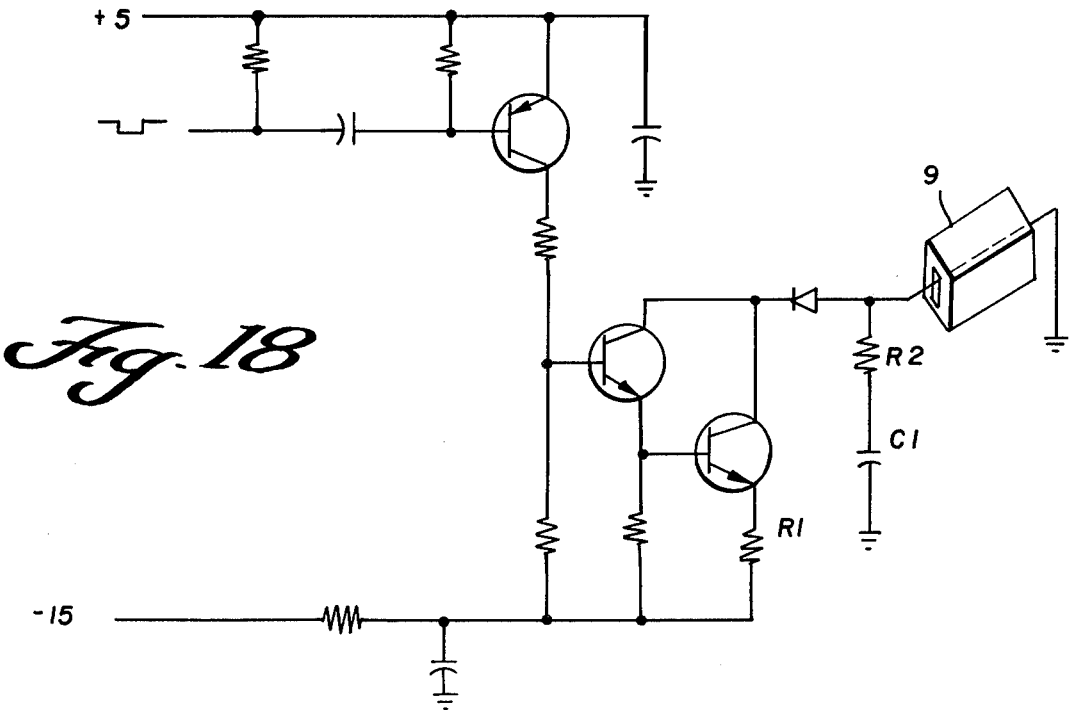
FIG. 18 is an electrical schematic of a typical reset output stage.

Typical output stages for the set and reset drivers are shown in FIGS. 17 and 18, respectively. The output stages for the set and reset drivers may be any currently available output stages.

The fast-switching technique described in conjunction with FIG. 4 requires a separate electronic circuit to be attached to each ferrite toroid 9 and 12, each of which is capable of resetting in both directions and setting in both directions from a reference point. As a result, the switching configuration can be described as requiring four reset/set drivers or four reset plus four set drivers. However, in many applications the switching time for the receive transition is the only one of major importance in a non-reciprocal phase shifter application. If this is the case, a simplified embodiment, shown in FIG. 19, may be used in place of the embodiment shown in FIG. 4. In FIG. 19 identical elements performing identical functions have the same reference number as in FIG. 4. In FIG. 19 (*a*) first set driver 52, a second set driver 53 and two reset drivers 54 and 55 are provided in place of the drivers 23 through 26 shown in FIG. 4. A switching technique in accordance with the teachings of the present invention can be devised for the circuit shown in FIG. 19 in which the transmit transition is accomplished using a technique similar to the prior art reset/set operation sequence while the receive transition is accomplished with the reset pulse occurring simultaneously with the set pulse on the opposite toroid. FIGS. 5 through 9, used in conjunction with FIG. 4, will also be used to discuss the operation of FIG. 19.

In a transmit switching operation, both toroids are returned to the "↑↑" state of magnetization which is referred to as the 0° state as shown in FIG. 5. For the transmit direction of propagation a positive phase advance requires ferrite 12 to be set while a negative phase requires ferrite 9 to be set. To go to a new transmit state, the ferrite which was previously set is reset prior to issuing the new set command. This technique is similar to the prior art reset/set operation except that in the present scheme the ferrite which is being reset is coming from a point on hysteresis loop representing a maximum of 180° of phase shift.

The prior art method of producing a receive state which is reciprocal to the corresponding transmit state (that is, one that has the same phase) would be to reverse the direction of magnetization on both ferrites as shown in FIG. 9. However, it is clear from FIG. 9 that the corresponding prior art receive state of FIG. 9(*b*) cannot be reached from the transmit state of FIG. 9(*a*) by only one switching operation on the ferrites 9 and 12, because both states of ferrites 9 and 12 are states of partial magnetization. The prior art receive state of FIG. 9 (*b*) be achieved only by resetting the ferrites 9 and 12 to the bottom end of the BH loop followed by a set pulse of approximately equal magnitude to that which was applied during the transmit operation.

As was described earlier, there are fortunately two magnetization patterns in the new switching technique which offer the same phase for the receive direction of propagation. If the state shown in FIG. 7 is selected as the reciprocal state for transmit, this state can be reached according to the present invention in one switching operation in which ferrite 9 is being set while ferrite 12 is simultaneously being reset. As a result, the receive transition according to the present invention can be accomplished with a minimum time corresponding to one switching operation. Furthermore, during the reset operation of FIG. 7, the magnetic flux to be reversed on the ferrite 12 (which is to be reset) never exceeds an equivalent 180° of flux change, whereas in the prior art transmit/receive operation the amount of magnetic flux to be reversed could correspond to a transition from $-B_r$ to $+B_r$ which in general would have represented approximately 500° of phase shift.

The switching operation described above maintains temperature stability during the phase shift achieved during the set pulse as is obtained using other controlled flux techniques. In addition, the amount of electrical circuitry required to achieve this configuration is less than that required for FIG. 4. The logic necessary to implement the circuitry is accordingly also reduced.

The new switching technique of the present invention may be used in apparatus requiring more than one dual-toroid phase shifter. Such an appartus, a reciprocal, constant amplitude, four-port microwave switch, is shown in block diagram form in FIG. 20 and physically represented in FIG. 21. In FIG. 21, a first magic tee 58 has a first input port 59 and a terminated second input port 60. A second magic tee 62 has a first output port 63 and a second output port 64. A first microwave path 67 extends between the first and second magic tees 58 and 62. A second microwave path 68 extends between the first magic tee 58 and the second magic tee 62 in parallel with the first microwave path 67. Each microwave path 67 and 68 includes a dual-toroid ferrite phase shifter 70 and 71, respectively. The phase shifters 70 and 71 are controlled by a driver circuit 73.

The reciprocal switch can be set to the desired setting using a flux drive technique rather than a multiple bit approach. Previous attempts at making a reciprocal switch using the configuration shown in FIG. 20 used major loop switching of the ferrites to equal an opposite magnetization states corresponding to the 0° state and the 180° state, respectively. See FIGS. 22 through 27. When the direction of propagation is reversed, the 0° state now appears to be the +180° state and vice versa. Therefore, the phase difference in the network is changed from +180 ° to −180° as the direction of propagation if reversed. Using the network of FIG. 20, the amplitude remains constant. Therefore, this device will function as a reciprocal switch in terms of amplitude.

However, a prior art controlled flux version of this switching arrangement will not maintain constant amplitude between the transmit and receive modes because of the non-linearity of the phase versus magnetization curves. When the direction of propagation is reversed, the reference state changes from the long state to the short state, and the differential phase shift achieved in the 180° state changes from transmit to receive as illustrated in FIGS. 22 through 27. Therefore, the amplitude is not reciprocal between the transmit and receive modes.

Using the dual-toroid switching technique of the present invention, symmetry arguments can be used to shown that between transmit and receive the differential phase shift remains constant as shown in FIGS. 28 through 33. Thus, in this device a controlled flux driver can maintain temperature stability of 180° phase shift and provide for electronic adjustment.

In summary, the new dual-toroid switching technique allows the construction of a four-port reciprocal switch (amplitude only) in which the 180° differential phase setting is determined by a flux drive approach rather than a major loop switching technique previously employed. The use of a flux drive approach to set the 180° differential phase state adds the inherent temperature stability associated with the controlled flux driver technique. By wiring the two phase shifters appropriately, the number of electronic drivers can be reduced to one reset driver and one set driver as shown in FIG. 34.

Figure 20:
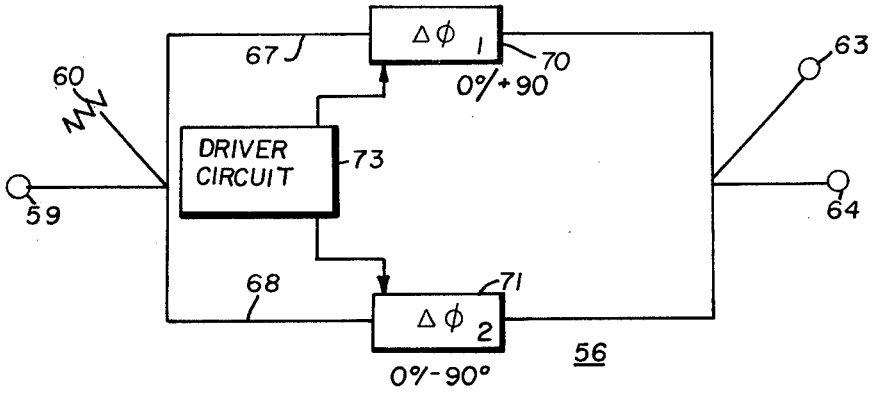
FIG. 20 is block diagram illustrating a reciprocal, four-port switch utilizing two, fast-switching, dual-toroid, microwave ferrite phase shifters constructed according to the teachings of the present invention.
Figures 21, 21A, 21B:
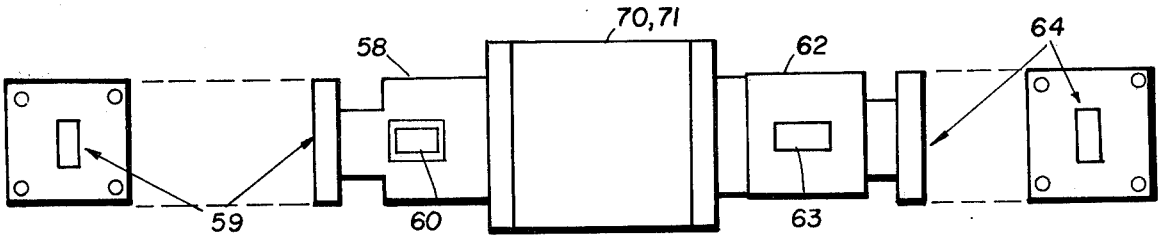
FIGS. 21, 21*a* and 21*b* illustrate the physical embodiment of the four-port switch shown in FIG. 20.
Figure 22:
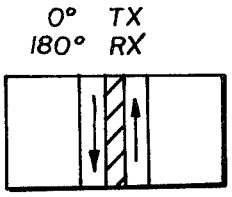
Fig. 22 PRIOR ART
FIGS. 22 and 23 illustrate the magnetization states and FIGS. 24 through 27 the associated hysteresis loops for the four ferrite cores of the four-port switch shown in FIG. 20 according to the teachings of the prior art.
Figures 24, 25:
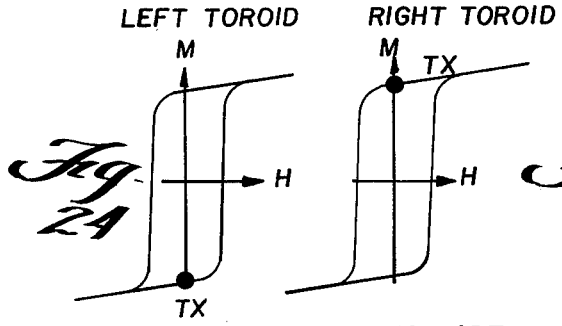
Figure 23:
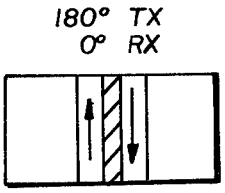
Fig. 23 PRIOR ART
Figures 26, 27:
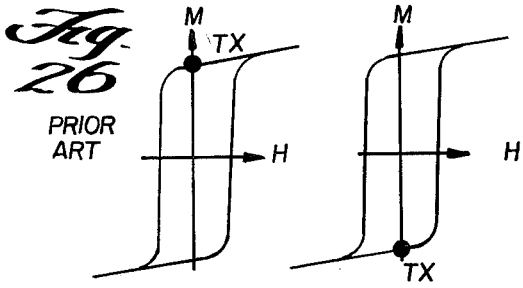

A modification of the four-port switching technique described in conjunction with FIG. 20 can be used to produce a transmit/receive switch in which the isolation response does not show the typical overshoot associated with the over-driving of the magnetization during the peak current of the reset pulse. This result can be achieved by driving both phase shifters during reset to a new 0° state, ("↑ ↑" state), in which a reciprocal phase shifter configuration is achieved. In this magnetization state, the insertion phase is only a weak function of the magnitude to the magnetization. Thus the phase has a significantly reduced overshoot at 0° compared to a conventional switching approach using either the long or short electrical states as a reference point.

The reciprocal four-port swith 56 shown in FIG. 20 may additionally be modified by replacing the magic tee 62 with a 3 dB 90° sidewall hybrid 78 as shown in FIG. 35. By using two 90° phase shifters in conjunction with the sidewall hybrid 78 an anti-reciprocal four-port circulator switch is produced. The anti-reciprocal four-port circulator switch is shown in block diagram form in FIG. 35 and is physically represented in FIG. 36. In FIGS. 35 and 36 identical components performing identical functions as in FIGS. 20 and 21 have the same reference numerals. In the configuration shown in FIG. 35, the phase shift is maintained at 90° between the transmit and receive directions resulting in the switch maintaining an ideal four-port circulator function in both directions. The configuration shown in FIG. 35 may be also used as a variable power divider.

By utilizing the new switching technique significant advantages for the variable power divider application are obtainable. In an electronic variable power divider one item of major importance is the ability to vary the amplitude from one attenuation state to another while maintaining constant insertion phase. According to the prior art technique of controlled flux switching, phase shifters 70 and 71 are set complimentary from 90°. That is, if the electrically long reference point is selected as the normal reset state, the phase is varied on one ferrite from 0° to +90°. On the other ferrite, the phase is varied corresponding to a complimentary state away from 90°. As a result, the resultant set state maintains a constant insertion phase since the average of the two phase settings remains equal to a constant, i.e., 45°. However, during the reset operation when both phase shifters are set to 0°, the variable power divider exhibits a 45° phase transient as its net phase changes rapidly by 45°. This results in a phase transient which disturbs the communication channel in which it is installed, if it is a normal phase modulation or frequency modulation system. For this reason, in networks involving such prior art variable power dividers it is necessary to insert a phase transient compensator which moves in the opposite direction of phase to counteract this effect. This additional component, which is inserted in series with the variable power divider, results in increased loss and additional electronic circuitry.

If the switching technique of the present invention is employed with a 0° state set to be the (↑ ↑) state on each phase shifter, one phase shifter is set to a negative phase setting while the other phase setting is set to a positive phase shift setting. See FIGS. 37 through 42. As a result, the insertion phase of the variable power divider remains constant even during the switching process assuming equal voltages are applied to both phase shifters. Therefore, no additional phase transient compensation is necessary using the new switching technique. This is a very significant advantage in terms of reducing the insertion loss and complexity of such a device.

The dual-toroid switching technique of the present invention also allows a new method of wiring the two phase shifters in series to minimize the electronics while maintaining a temperature stable flux drive situation. The set pulse in this case is applied with two toroids of corresponding phase shifters wired in series. If the voltage divides equally, the phase shift setting on each phase shifter will be approximately equal in magnitude but opposite in sign, thereby maintaining an equal insertion phase. This is illustrated in FIG. 43.

The design illustrated in FIG. 35 can also be used to produce an anti-reciprocal four-port circulator switch, in which 90° phase shifters are employed instead of 180° phase shifters. Using the controlled flux technique with dual-toroid switching, four-port circulator action can be achieved in both directions of propagation and 90° differential phase shift setting can be achieved using flux drive.

In summary, the new dual-toroid switching technique illustrated in FIG. 35 may be used as an anti-reciprocal four-port circulator switch and a variable power divider. In the variable power divider application the phase transients associated with reset operation are reduced to a minimum. This result stems from the fact that both phase shifters are driven symmetrically away from the 0° state rather than in a unipolar direction as previously used when coming from the electrical long state.

The new dual-toroid stitching technique disclosed herein provides a new method of using two phase shifters in series to minimize electronics while maintaining a temperature stable flux drive situation. It will be apparent to those skilled in the art that modifications of the dual-toroid phase shifter and additional applications in which more than one dual-toroid phase shifter is utilized may be made. The claims following below are intended to encompass all such modifications which fall within the spirit and scope of the present invention.

What is claimed is:

1. A fast-switching, dual toroid microwave phase shifter, comprising:

first and second toroids having ferrite cores and disposed in a microwave waveguide;

first means for controllably switching the ferrite in one of the toroids between a saturated state and a partially saturated state;

second means for controllably switching the ferrite in the other of said toroids between a saturated state and a partially saturated state; and control means for controlling said first and said second means such that the ferrite in at least one of said toroids is maintained in the saturated state at any given time such that any desired phase shift may be achieved with only one switching operation for each toroid.

2. A phase shifter as in claim 1 wherein said first and second toroids are disposed in parallel in the microwave waveguide and separated by a dielectric.

3. A phase shifter as in claim 2 further including a mode suppressor and a matching transformer disposed in the waveguide.

4. A phase shifter as in claim 1 wherein said first and second toroids are disposed in series in the microwave waveguide.

5. A phase shifter as in claim 1 wherein said first and second toroids comprise a single overall toroid structure having a first portion acting as said first toroid and a second portion acting as said second toroid.

6. A phase shifter as in claim 1 wherein said control means includes means for simultaneously causing said switching of the ferrites in the first and second toroids.

7. A phase shifter as in claim 1 wherein the first means includes a first and a second driver each switching one of the ferrites of one of the toroids between opposite saturated and partially saturated states and wherein the second means includes a third and a fourth driver each switching the other of the ferrites of the other toroids between opposite saturated and partially saturated states.

8. A phase shifter as in claim 7 wherein the first, second, third and fourth drivers each contain a set driver for driving the ferrites to partially saturated states and a reset driver for driving the ferrites to saturated states.

9. A phase shifter as in claim 8 wherein each of the set drivers produces fixed amplitude variable width voltage pulses for driving the ferrites to partially saturated states.

10. A phase shifter as in claim 8 wherein each of the set drivers produces variable amplitude fixed width voltage pulses for driving the ferrites to partially saturated states.

11. A phase shifter as in claim 8 including means for sensing the voltage induced in each ferrite and wherein each of the set drivers produces variable amplitude fixed width voltage pulses responsive to said sensed voltage for driving the ferrites to partially saturated states.

12. A phase shifter as in claim 8 including means for integrating the voltage applied to each ferrite and wherein each of the set drivers produces variable amplitude quasi-constant width voltage pulses responsive to said means for integrating for driving the ferrites to partially saturated states.

13. A phase shifter as in claim 1 wherein the control means includes a programmable memory, a digital-to-analog converter responsive to said memory for inputting control signals to the first and second switching means and timing means for activating said first and second switching means for receiving said control signals.

14. A phase shifter as in claim 13 wherein the timing means includes a timing control circuit and a timing demultiplexer responsive to said timing control circuit for activating said first and second switching means.

15. A phase shifter as in claim 13 wherein the programmable memory contains a unique linearizing function for the phase shifter.

16. A method for switching of a dual toroid microwave ferrite phase shifter wherein the ferrite of at least one of said toroids is maintained in a saturated state at any given time; said method comprising:

switching the ferrite of said saturated toroid to a predetermined partially saturated state; and switching said other ferrite of said other toroid to a saturated state such that any desired change in phase shift may be achieved with only one switching operation for each ferrite of each toroid.

17. The method of claim 16 wherein the step of switching said saturated ferrite to a predetermined partially saturated state includes the steps of generating a digital signal representative of said partially saturated state and converting said digital signal to an analog signal.

18. The method of claim 16 wherein both of said switching steps are performed substantially simultaneously.

19. The method of claim 16 including the step of activating the toroid drivers before the switching steps.

20. The method of claim 16 wherein the step of switching one of the ferrites to a partially saturated state includes the step of producing a fixed amplitude variable width voltage pulse for driving said ferrite to said partially saturated stated.

21. The method of claim 16 wherein the step of switching one of the ferrites to a partially saturated state includes the step of producing a variable amplitude fixed width voltage pulse for driving said ferrite to said partially saturated stated.

22. The method of claim 16 including the step of sensing the voltage induced in each ferrite for controlling the switching to a partially saturated state.

23. The method of claim 16 including the step of integrating the voltage applied to each ferrite for controlling the switching to a partially saturated state.

24. A fast-switching dual toroid microwave transmit/receive mode phase shifter, comprising:

first and second toroids having ferrite cores disposed in a microwave waveguide;

first means for switching one of the ferrites in one of the toroids to a partially saturated state;

second means for switching the other of the ferrites in the other of the toroids to a partially saturated state;

third means for switching both of said ferrites to a saturated state; and control means for controlling said first, second and third means such that when said switch is in a transmit mode, at least a first one of said ferrites is maintained in the saturated state and wherein a receive mode is achieved by switching the other ferrite to a saturated state while simultaneously switching the first ferrite to a partially saturated state such that the opposite mode of operation is achieved in a minimum time corresponding to only one simultaneous switching operation for each ferrite.

25. A phase shifter as in claim 24 wherein the dual toroids include two toroids disposed in parallel in the microwave waveguide and separated by a dielectric.

26. A phase shifter as in claim 25 further including a mode suppressor and a matching transformer disposed in the waveguide.

27. A phase shifter as in claim 24 wherein each of the first and second means produces fixed amplitude variable width voltage pulses for driving the ferrites to partially set states.

28. A phase shifter as in claim 24 wherein each of the first and second means produces variable amplitude fixed width voltage pulses for driving the ferrites to partially saturated states.

29. A phase shifter as in claim 24 including means for sensing the voltage induced in each ferrite and wherein each of the first and second means produces variable amplitude fixed width voltage pulses responsive to said sensed voltage for driving the ferrites to partially saturated states.

30. A phase shifter as in claim 24 including means for integrating the voltage applied to each ferrite and wherein each of the first and second means produces variable amplitude quasi-constant width voltage pulses responsive to said means for integrating for driving the ferrites to partially saturated states.

31. A phase shifter as in claim 24 wherein the control means includes a programmable memory, a digital-to-analog converter responsive to said memory for inputting control signals to the first, second and third switching means and timing means for activating said first, second and third switching means for receiving said control signals.

32. A phase shifter as in claim 31 wherein the timing means includes a timing control circuit and a timing demultiplexer responsive to said timing control circuit for activating said first, second and third switching means.

33. A phase shifter as in claim 31 wherein the programmable memory contains a unique linearizing function for the phase shifter.

34. A method for switching a dual toroid microwave transmit/receive mode ferrite phase shifter, comprising:

initially setting said phase shifter in one of said transmit and receive modes wherein at least a first one of said toroids is maintained in a saturated state;

switching the other toroid to a saturated state; and simultaneously switching the first toroid to a partially saturated state such that the opposite mode is achieved in a minimum time corresponding to only one simultaneous switching operation for each toroid.

35. The method of claim 34 wherein the step of initially setting said phase shifter includes the step of switching the other toroid to a saturated state and switching the first of said toroids to a partially saturated state.

36. The method of claim 34 wherein the step of simultaneously switching the first toroid to a predetermined partially saturated state includes the steps of generating a digital signal representative of said partially saturated state and converting said digital signal to an analog signal.

37. The method of claim 34 including the step of activating toroid drivers before the switching steps.

38. The method of claim 34 wherein the step of simultaneously switching the first toroid to a partially saturated state includes the step of producing a fixed amplitude variable width voltage pulse for driving said toroid to said partially saturated state.

39. The method of claim 34 wherein the step of simultaneously switching the first toroid to a partially saturated state includes the step of producing a variable amplitude fixed width voltage pulse for driving said toroid to said partially saturated state.

40. The method of claim 34 including the step of sensing the voltage induced in each toroid for controlling the switching to a partially saturated state.

41. The method of claim 34 including the step of integrating the voltage applied to each toroid for controlling the switching to a partially saturated state.

42. A reciprocal, constant amplitude, four port microwave switch, comprising:

a first input port;

output means having two output ports;

a first microwave path extending between said first input port and said output means and including two toroids with ferrite cores disposed in said path;

a second microwave path extending between said first input port and said output means in parallel with said first path and including two toroids with ferrite cores disposed in said path;

a set driver for switching the ferrite in said toroids to partially saturated states;

a reset driver for switching the ferrite in said toroids to saturated states; and control means for controlling said set and reset drivers such that at least one of the ferrites of said toroids within each pair is maintained in the saturated state at any given time such that the reciprocal mode may be achieved with only one switching operation for each toroid.

43. A switch as in claim 42 wherein the first and second microwave paths each introduce a differential phase shift of zero or one hundred and eighty degrees.

44. A switch as in claim 42 wherein each pair of toroids includes two toroids disposed in parallel in the first and second microwave paths.

45. A switch as in claim 44 further including a mode suppressor and a matching transformer disposed in the first and second microwave paths.

46. A switch as in claim 42 wherein the set driver produces fixed amplitude variable width voltage pulses for driving the ferrites to partially saturated states.

47. A switch as in claim 42 wherein the set driver produces variable amplitude fixed width voltage pulses for driving the ferrites to partially saturated states.

48. A switch as in claim 42 including means for sensing the voltage induced in each ferrite and wherein the set driver produces variable amplitude fixed width voltage pulses responsive to said sensed voltage for driving the ferrites to partially saturated states.

49. A switch as in claim 42 including means for integrating the voltage applied to each ferrite and wherein the set driver produces variable amplitude quasi-constant width voltage pulses responsive to said means for integrating for driving the ferrites to partially saturated states.

50. A switch as in claim 42 wherein the control means includes a programmable memory, a digital-to-analog converter responsive to said memory for inputting control signals to the set and reset drivers and timing means for activating said set and reset drivers for receiving said control signals.

51. A switch as in claim 50 wherein the timing means includes a timing control circuit and a timing demultiplexer responsive to said timing circuit for activating said set and reset drivers.

52. A switch as in claim 50 wherein the programmable memory contains a unique linearizing function for each pair of toroids.

53. A method of switching a reciprocal constant amplitude four port microwave switch having two dual toroid ferrite phase shifters, comprising:

maintaining, at any given time, the ferrite of at least one of the toroids in each of the dual toroid ferrite phase shifters in a saturated state;

driving each of said saturated toroids to predetermined partially saturated states complementary of the states of the remaining toroid in the other phase shifter; and simultaneously driving said remaining toroids to saturated states complementary of the states of the previously saturated toroids such that the reciprocal mode is achieved with only one simultaneous switching operation for each toroid.

54. The method of claim 53 wherein the step of driving said saturated ferrites to predetermined partially saturated states includes the steps of generating digital signals representative of said partially saturated states and converting said digital signals to analog signals.

55. The method of claim 53 including the step of activating the toroid drivers before the driving steps.

56. The method of claim 53 wherein the step of driving the ferrites to partially saturated states includes the step of producing fixed amplitude variable width voltage pulses for driving said ferrites to said partially saturated states.

57. The method of claim 53 wherein the step of driving the ferrites to partially saturated states includes the step of producing variable amplitude fixed width voltage pulses for driving said ferrites to said partially saturated states.

58. The method of claim 53 including the step of sensing the voltage induced in each of the ferrites for controlling the driving to partially saturated states.

59. The method of claim 53 including the step of integrating the voltage applied to each ferrite for controlling the switching to partially saturated states.

60. An anti-reciprocal, four port microwave switch, comprising:

an input port;

a sidewall hybrid;

a first microwave path extending between said input port and said sidewall hybrid and including two toroids with ferrite cores disposed in said path;

a second microwave path extending between said input port and said sidewall hybrid in parallel with said first path and including two toroids with ferrite cores disposed in said path;

first means for switching the ferrite of said toroids to partially saturated states;

second means for switching the ferrite of said toroids to saturated states; and control means for controlling said first and second means such that at least one of said ferrites within each pair is maintained in the saturated state, at any given time, such that any subsequently desired phase shift may be achieved with only one simultaneous switching operation for each ferrite.

61. A switch as in claim 60 wherein the first and second microwave paths each provide a ninety degree differential phase shift for both directions of propagation such that said switch provides a four port circulator function.

62. A switch as in claim 60 wherein the first microwave path provides a differential phase shift of between −45° and +45° degrees and wherein the second microwave path provides a complementary differential phase shift of between +45° and −45° degrees thereby providing a constant insertion phase such that said switch provides a variable power divider function.

63. A switch as in claim 60 wherein each pair of toroids includes two toroids disposed in parallel in the first and second microwave paths.

64. A switch as in claim 63 further including a mode suppressor and a matching transformer disposed in the first and second microwave paths.

65. A switch as in claim 60 wherein the first means includes a first and a second set drivers and wherein the second means includes a reset driver.

66. A switch as in claim 65 wherein each of the set drivers produces fixed amplitude variable width voltage pulses for driving the ferrites to partially saturated states.

67. A switch as in claim 65 wherein each of the set drivers produces variable amplitude fixed width voltage pulses for driving the ferrites to partially saturated states.

68. A switch as in claim 65 including means for sensing the voltage induced in each ferrite and wherein each of the set drivers produces variable amplitude fixed width voltage pulses responsive to said sensed voltage for driving the ferrites to partially saturated states.

69. A switch as in claim 65 including means for integrating the voltage applied to each ferrite and wherein each of the set drivers produces variable amplitude quasi-constant width voltage pulses responsive to said means for integrating for driving the ferrites to partially saturated states.

70. A switch as in claim 60 wherein the control means includes a programmable memory, a digital-to-analog converter responsive to said memory for inputting control signals to the first and second switching means and timing means for activating said first and second switching means for receiving said control signals.

71. A switch as in claim 70 wherein the timing means includes a timing control circuit and a timing demultiplexer responsive to said timing control circuit for activating said first and second switching means.

72. A switch as in claim 70 wherein the programmable memory contains a unique linearizing function for each pair of toroids.

73. A method of switching an anti-reciprocal, four port, microwave switch having two dual toroid ferrite phase shifters, comprising:

maintaining, at any given time, the ferrite of at least one of the toroids in each of the dual toroid phase shifters in a saturated state;

driving said saturated ferrites to predetermined partially saturated states; and simultaneously driving the remaining ferrites of the other toroids to saturated states such that any desired phase change may be achieved with only one simultaneous switching operation for each ferrite.

74. The method of claim 73 wherein the step of driving said saturated ferrites to predetermined partially saturated states includes the steps of generating a digital signal representative of said partially saturated states and converting said digital signal to an analog signal.

75. The method of claim 73 including the step of activating the toroid drivers before the driving steps.

76. The method of claim 73 wherein the step of driving the ferrites to partially saturated states includes the step of producing fixed amplitude variable width voltage pulses for driving said ferrites to said partially saturated states.

77. The method of claim 73 wherein the step of driving the ferrites to partially saturated states includes the step of producing variable amplitude fixed width voltage pulses for driving said ferrites to said partially saturated states.

78. The method of claim 73 including the step of sensing the voltage induced in each ferrite for controlling the driving to partially saturated states.

79. The method of claim 73 including the step of integrating the voltage applied to each ferrite for controlling the driving to partially saturated states.

* * * * *